US006857577B2

(12) United States Patent
Hunka

(10) Patent No.: US 6,857,577 B2
(45) Date of Patent: Feb. 22, 2005

(54) THERMALLY POWERED VAV DIFFUSER AND CONTROL ASSEMBLY

(75) Inventor: Robert S. Hunka, Oakland, CA (US)

(73) Assignee: Acutherm L.P., Hayward, CA (US)

( * ) Notice: Subject to any disclaimer, the term of this patent is extended or adjusted under 35 U.S.C. 154(b) by 0 days.

(21) Appl. No.: 10/791,045

(22) Filed: Mar. 1, 2004

(65) Prior Publication Data

US 2004/0169089 A1 Sep. 2, 2004

Related U.S. Application Data

(62) Division of application No. 10/060,816, filed on Feb. 1, 2002, now Pat. No. 6,736,326.

(51) Int. Cl.[7] ..... F24F 7/00

(52) U.S. Cl. ..... 236/49.5; 236/99 E; 454/258

(58) Field of Search ..... 236/1 C, 49.5, 236/99 E; 454/258

(56) References Cited

U.S. PATENT DOCUMENTS

| | | | |
|---|---|---|---|
| RE30,953 | E | 6/1982 | Vance et al. |
| 4,491,270 | A | 1/1985 | Brand |
| 4,509,678 | A | 4/1985 | Noll |
| 4,515,069 | A | 5/1985 | Kline et al. |
| 4,523,713 | A | 6/1985 | Kline et al. |
| 4,537,347 | A | 8/1985 | Noll et al. |
| 4,821,955 | A | 4/1989 | Kline et al. |
| 5,647,532 | A | 7/1997 | de Villiers et al. |
| 5,673,851 | A | 10/1997 | Dozier et al. |
| 5,860,592 | A | 1/1999 | Dozier et al. |
| 6,176,435 | B1 | 1/2001 | Nielsen |
| 6,254,010 | B1 | 7/2001 | de Villiers |

*Primary Examiner*—William E. Tapolcai
(74) *Attorney, Agent, or Firm*—Dorsey & Whitney LLP

(57) ABSTRACT

A thermally powered VAV diffuser assembly (21, 221) having a housing (42, 242) formed for coupling to a supply air duct or conduit (22, 222), a damper (24, 224) mounted across a supply air opening (27, 227) for movement relative thereto to vary the volume of supply air discharge from the diffuser and a thermally powered damper position controlled device or assembly (28, 228). The control assembly (28, 228) includes not more than two sensor-actuators (31, 32, 231, 232) and a movable linkage assembly. The linkage assembly transmits movement of the sensor-actuators (31, 32, 231, 232) to the damper (24, 224) for displacement of the damper (24, 224) to vary the volume discharged and to produce change-overs between heating and cooling modes. The heating mode and cooling mode set point temperatures are each independently adjustable, and the movable linkage assembly includes a lever (33, 233) pivoted about two pivot points by axles (82, 83, 282, 283) which slide in slots (87, 88, 287, 288). The sensor-actuators (31, 32, 231, 232) and all of the movable linkage assembly are located on a room side of the movable damper (24, 224) so that removal of the appearance panel (34, 234) exposes these elements for ease of maintenance, repair and replacement. An adjustable minimum flow stop (233*a*, 233*b*, 233*c*) balancing arm (220) and change-over linkage (275) also are provided.

10 Claims, 17 Drawing Sheets

THERMALLY POWERED VAV DIFFUSER AND CONTROL ASSEMBLY

CROSS-REFERENCES TO RELATED APPLICATIONS

This application is a Divisional of U.S. patent application Ser. No. 10/060,816, filed Feb. 1, 2002 now U.S. Pat. No. 6,736,326 and entitled "THERMALLY POWERED VAV DIFFUSER AND CONTROL ASSEMBLY", the entire contents of which is incorporated herein by this reference.

TECHNICAL FIELD

The present invention relates, in general, to thermally powered VAV diffusers of the type used in heating, ventilating and air conditioning (HVAC) systems, and more particularly, relates to systems employing a thermally powered sensor-actuator to move the damper or blade assembly of an air diffuser to vary the volume of air discharged from the diffuser.

BACKGROUND ART

Thermally powered air diffusers have been widely employed in HVAC systems. The control assembly for such VAV diffusers typically employs a plurality of thermal sensor-actuators and a damper displacing linkage assembly. The sensor-actuators each have a contained wax that expands and contracts with temperature changes and drives a piston. The piston, in turn, is used to displace the linkage assembly that controls the position of the diffuser damper, baffle, disk or blade assembly. Thermally powered VAV diffuser assemblies, for example, are shown in U.S. Pat. No. Re30,953, U.S. Pat. Nos. 4,491,270, 4,509,678, 4,515,069, 4,523,713, 4,537,347, 4,821,955 and 5,647,532.

U.S. Pat. Nos. 4,491,270 and 4,523,713 are typical of VAV diffusers employing three thermal sensor-actuators in the a diffuser in order to be capable of modulating or varying the volume of air flow in both heating and cooling modes. It also will be noted that in both of these patents there is at least one sensor-actuator, the supply air sensor-actuator, which is positioned above the movable damper or disk of the diffuser so as to sense the supply air temperature in the neck of the diffuser. In U.S. Pat. No. 4,491,270, there actually are four sensor-actuators with two supply air sensor-actuators in the neck of the diffuser above a transverse plate which divides the neck elements from the room air sensor-actuators. Moreover, part of the linkage between the sensor-actuators is in the neck of the diffuser above the damper and above the transverse wall between the neck and room air sensor-actuators.

While the diffusers of these patents have operated for many years in commercial settings with only minor maintenance being required, when maintenance is required on the supply air sensor-actuator or portion of the control linkage above the damper, such maintenance can require removal of the diffuser from the supply air conduit for maintenance, repair or replacement.

The thermally-powered VAV diffuser of U.S. Pat. Nos. 4,509,678 and 5,647,532 employ only two sensor-actuator elements in order to power the movement of the damper or diffuser disk. Again, however, one of the sensor-actuators is located above the damper or disk, as is part or most of the control linkage assembly. This makes maintenance and/or replacement of the sensor-actuator and linkage components in the neck of the diffuser more difficult. The VAV diffuser of U.S. Pat. No. 4,509,678 also is not capable of variable air volume (VAV) discharge in both heating and cooling modes. Instead, the linkage assembly controlling damper position is constructed in a manner such that in the heating mode the diffuser damper disk is moved to a pre-adjusted discharge opening and remains at that position.

In U.S. Pat. No. 5,647,532 VAV operation is possible in both heating and cooling modes. While the temperature set point at which the damper opens is not discussed in U.S. Pat. No. 5,647,532, the diffuser of the patent is commercially available from the patent owner, Brian Rickard (Pty) Ltd. The commercially available diffuser has one adjustable temperature set point. Adjustment requires that the control linkage be lowered down out of the diffuser housing to get access to the adjustment, and a single adjustment is all that is provided. Any adjustment of the cooling temperature set point, therefore, also adjusts the heating temperature set point, and visa versa.

Accordingly, it is an object of the present invention to provide a thermally powered control assembly, and a VAV diffuser controlled by such assembly, which has a minimum number of thermal sensor-actuators and yet is capable of VAV operation in heating and cooling modes with independently adjustable set point temperatures for each mode.

A further object of the present invention is to provide a thermally powered VAV diffuser and control assembly therefor in which the thermal sensor-actuators and the linkage assembly which drive the damper for the diffuser are all easily exposed for maintenance, repair and replacement.

Another object of the present invention is to provide a thermally powered VAV diffuser and control assembly therefor that can be biased to a normally open position or can be biased to a normally closed position.

Another object of the present invention is to provide a thermally powered VAV diffuser in which the damper moves to a closed position during change over between heating and cooling modes.

Still another object of the present invention is to provide a thermally powered VAV diffuser and control assembly therefor which has a minimum flow stop assembly that is adjustable and easily accessible.

Another object of the present invention is to provide a thermally powered VAV diffuser in which the damper member can be dropped to a fully open position for system balancing without removing the appearance panel.

Still a further object of the present invention is to provide a thermally powered control assembly for a VAV diffuser which is less complex and accordingly is less costly to manufacture, requires less maintenance and has higher durability.

Another object of the present invention is to provide a thermally powered VAV diffuser assembly which employs a minimum number of thermal sensor-actuators and has independently adjustable set point temperatures which can be easily accessed for adjusting.

Still a further object of the present invention is to provide a VAV diffuser, and control assembly therefor, which has improved room air induction for more accurate sensing of the room air temperature and VAV control.

Still another object of the present invention is to provide an improved damper assembly mounting structure for a VAV diffuser in which the damper is supported by roller bearing elements.

The thermally powered VAV diffuser and control assembly of the present invention have other objects and features of advantage which will become apparent from, and are set forth in more detail in, the accompanying drawing and following the Best Mode of Carrying Out the Invention.

DISCLOSURE OF THE INVENTION

The thermally powered VAV diffuser assembly of the present invention comprises, briefly, a diffuser housing formed for coupling to a supply air conduct and formed for discharge of supply air therefrom; a damper mounted across a supply air opening in the diffuser housing for movement relative thereto to vary the volume of supply air discharged from the diffuser; and a thermally powered damper position control assembly. The control assembly includes not more than two thermal sensor-actuators and a movable linkage operatively associated with the damper and with the sensor-actuators to transmit movement of the sensor-actuators for displacement of the damper to vary the volume of supply air discharged from the diffuser in heating and cooling modes.

In the present invention the movable linkage assembly is formed to enable the set point temperatures at which the damper begins to open to be set and adjusted independently for each of the heating and cooling modes. Moreover, in the present invention the two thermal sensor-actuators and damper driver linkage assembly are easily exposed while the diffuser is still mounted in the ceiling for maintenance, repair and replacement by removal of the diffuser appearance panel and a readily accessible mounting plate.

The most preferred linkage assembly employs a pivoted lever which is mounted for pivoting about two pivot points. The supply air sensor-actuator produces change-over in the operating mode by pivoting of the lever between one or the other of the two pivot points, while a room air sensor-actuator produces displacement of the lever about the selected pivot point for VAV operation during both heating and cooling modes. Supply air is used to induce room air flow past the room air temperature sensor-actuator, as well as to effect change over between modes.

The pivoted lever advantageously is a compound lever arm which has an adjustable configuration to enable adjustment of the minimum flow of supply air discharged from the diffuser when the damper member is in a closed position.

The lever can be spring biased to a normally closed position or gravity biased to a normally open position, and most preferably the linkage assembly includes a change over linkage that moves the damper member to the closed position each time the diffuser changes over between heating and cooling modes. A balancing arm also may be provided which allows the damper to be dropped to a fully open position, permitting system balancing, without having to remove the diffuser appearance panel.

BRIEF DESCRIPTION OF THE DRAWING

In FIG. 5B the cross section is taken at the midpoint of the lever arm while in FIGS. 5A, 5C and 5D the near side of the lever arm is shown.

BEST MODE OF CARRYING OUT THE INVENTION

Figure 1:
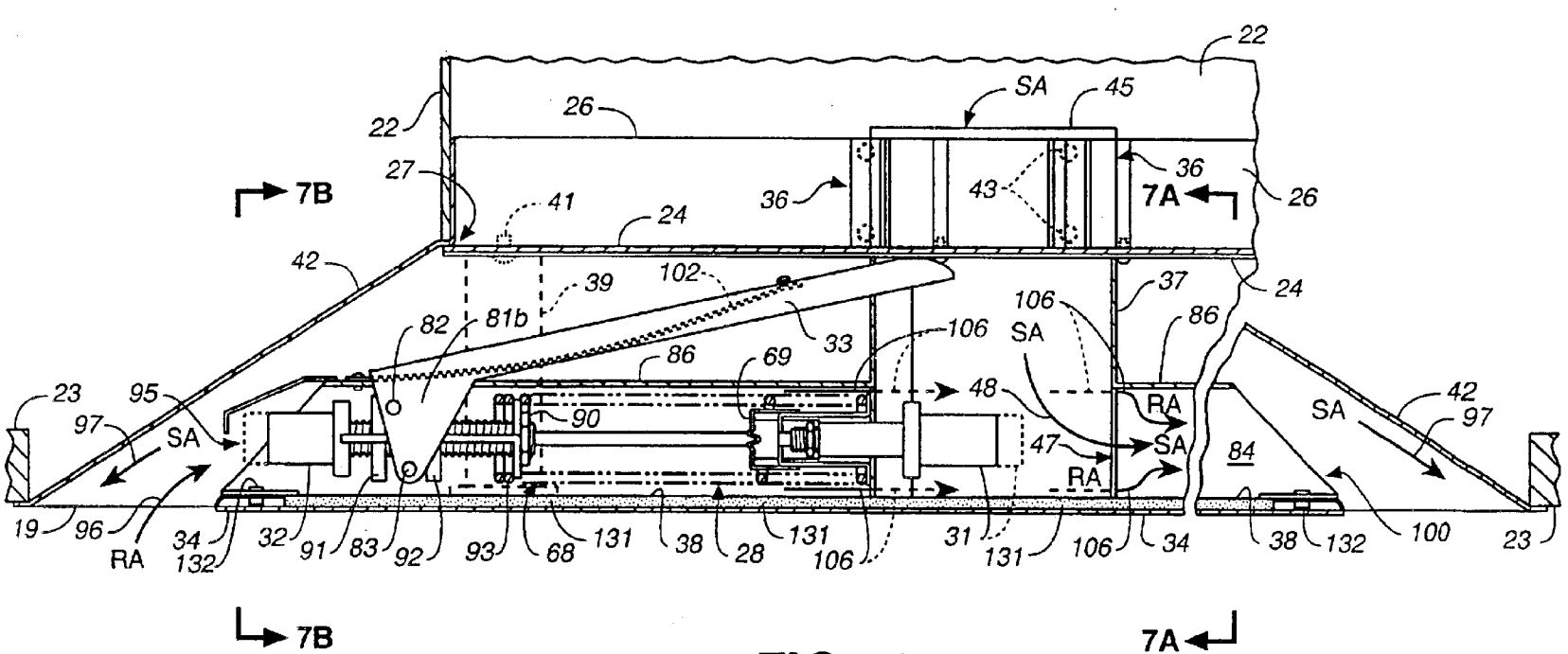
FIG. 1 is a fragmentary, side elevation view in cross section of a thermally powered VAV diffuser constructed in accordance with the present invention.

Referring now to FIG. 1, the overall operation of thermally powered VAV diffuser 21 can be briefly described. VAV diffuser 21 is mounted to a supply air conduit 22 with a lower edge 19 of the truncated, pyramidal housing 42 of the diffuser positioned to be generally flush with ceiling panels 23 of the room or space into which supply air is to be discharged. A supply air source (not shown) is fluid coupled to conduit 22, and the supply air source preferably is capable of producing both relatively warm or hot supply air and relatively cool or cold supply air. In variable-air-volume (VAV) systems the supply air source usually does not vary the temperature of the supply air in order to control the temperature of a room, other than to change over between warm air and cool air. The temperature of the room is controlled by varying the volume of supply air discharged from the VAV diffuser into the room.

Diffuser 21 includes a movable damper member 24, which is mounted across a supply air opening 27 (see also, FIG. 9) in the diffuser. Damper 24 is mounted for movement relative to opening 27 so as to enable variation of the volume of supply air discharged from supply air conduit 22 out of the diffuser and into the room. The volume of either hot or cold supply air, therefore, is controlled by damper member 24 in order to control the air temperature of the room.

VAV diffuser 21 includes a damper position control device or assembly, generally designated 28. Such damper position control assemblies are broadly known in the prior art and they typically include a plurality of thermal sensor-actuators and a movable linkage assembly which is operatively associated with the sensor-actuators and the damper to produce damper movement in response to sensed temperature changes. As used herein, "associated" shall include linkages which are coupled to the damper or sensor-actuator at all times and linkages which move into and out of contact with the damper and/or sensor-actuator.

Generally, damper position control assemblies include at least one sensor-actuator which senses supply air temperature and responds thereto to displace a piston. If warm air is provided in supply air conduit 22, the supply air sensor-actuator piston is displaced outwardly as the wax in the supply air sensor-actuator expands. If cool air is provided in supply air conduit 22, the wax in the supply air sensor-actuator contracts and the piston retracts.

The movement of the supply air sensor-actuator is used in prior art diffusers, and the present diffuser, to "change-over" between a heating mode and a cooling mode. The remaining sensor-actuator in prior art systems, and the present system, is positioned to sense room air temperature. If the sensed room air temperature is warm, the wax will expand and the piston of such room air temperature sensor-actuator will extend, while if the room air temperature is relatively cool, the piston of the room air sensor-actuator will retract. The movable linkage assembly is constructed so that the damper, baffle, blades or disk (all of which are herein referred to as a "damper" or "damper member") will be displaced relative to the supply air discharge opening 27 so as to vary the air volume discharge from the diffuser.

In a heating mode, the air volume discharge from the diffuser will be a maximum for a cool room and will gradually be reduced as the room warms up, as sensed by the room air sensor-actuator. Conversely, as the room cools back down, the room air sensor-actuator will open the diffuser to discharge more warm air into the room and maintain the room air temperature above a room air temperature set point.

In the cooling mode, if the room air sensor-actuator senses that the room is cool, the room air sensor actuator will cause the damper moved to a closed position. As the room air temperature increases, the room air temperature sensor-actuator will cause the damper to open so as to allow cool air to flow into the room.

The room air temperature sensor-actuator modulates or varies the damper position to try and maintain the room air below an adjustable cooling set point temperature in cooling mode and above an adjustable heating set point temperature in a heating mode.

As above-noted, often three or more sensor-actuators are employed in prior art systems, together with rather complex linkage assemblies, in order to effectuate variable air volume control for both heating and cooling modes. In the diffuser of the present invention, however, only two thermal sensor-actuators are required and a movable linkage assembly has been created which is capable of VAV operation for both heating and cooling modes with an independently adjustable set point temperature for each mode.

Returning again to FIG. 1, a supply air temperature sensor-actuator 31 and a room air temperature sensor-actuator 32 are associated by a movable linkage assembly so as to pivot a damper lever 33 in a manner vertically displacing damper member 24. As will be seen from FIG. 1, both sensor-actuator 31 and sensor-actuator 32, as well as all of the movable linkage assembly are positioned below or on the room side of damper member 24 and, as will be described below, are easily accessible from the room without removing the diffuser from the ceiling or the control assembly from the diffuser. This construction has the highly beneficial effect of allowing diffuser 21 to have all of its damper position control apparatus located for easy replacement, maintenance and repair. Moreover, as will be described in more detail, adjustment of the set point temperatures for both heating and cooling modes and adjustment of the minimum air flow also can be easily made simply by pivoting down, or removing, diffuser appearance panel 34.

Supply Air and Room Air Flow Paths

The supply air and room air temperature sensor-actuators need to be positioned for exposure to supply air and room air, respectively. In prior art diffusers the supply air sensor-actuator has usually been positioned above the damper in the neck of the diffuser or up in the supply air conduit. Room air sensor-actuators have been positioned below the damper, often in a room air induction channel provided in the diffuser.

Figure 4:
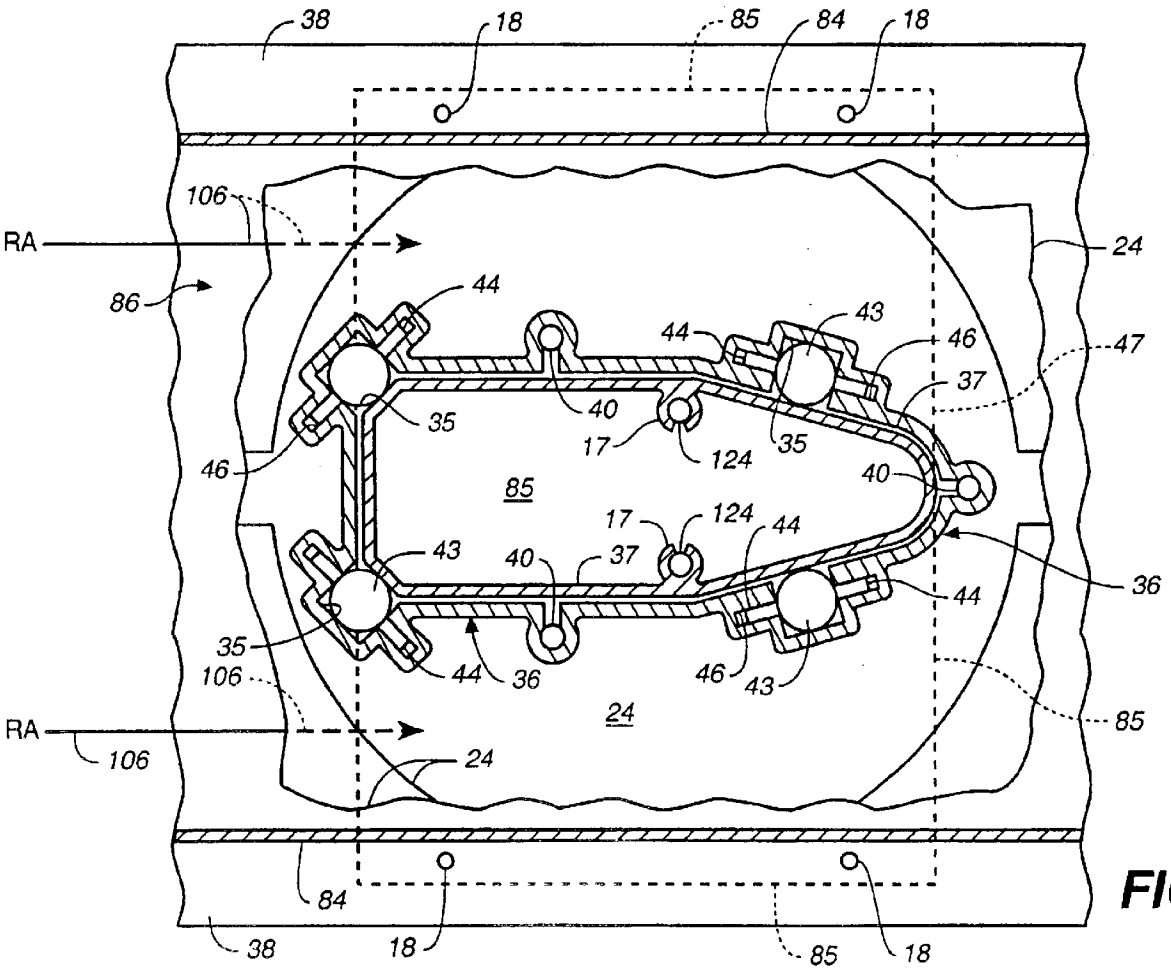
FIG. 4 is a fragmentary, top plan view in cross section of the supply air flow tube and damper assembly.
Figure 7A:
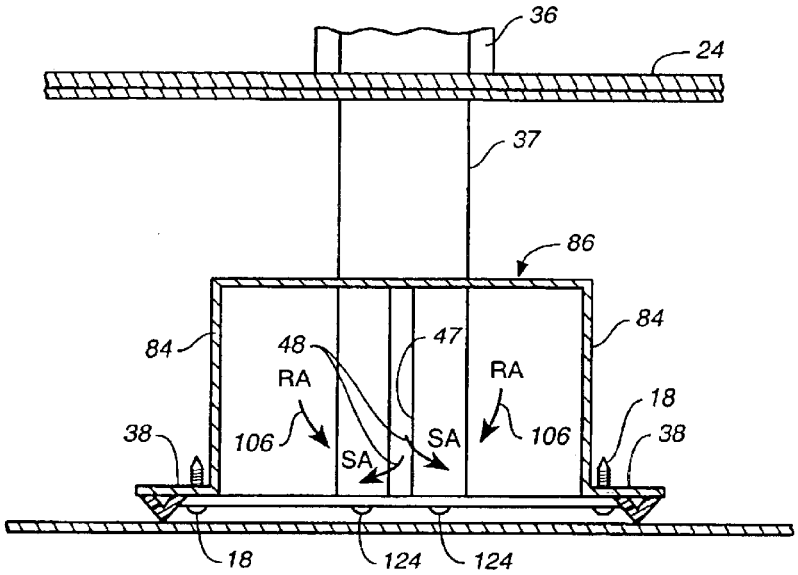
FIGS. 7A and 7B are a fragmentary, front elevation views, taken substantially along the planes of lines 7A—7A and 7B—7B in FIG. 1.

In diffuser 21, a vertically extending supply air flow tube 37 extends downwardly through damper member 24, preferably at about the center of the damper. Tube 37 advantageously has an elongated cross section, as seen in FIG. 4, and has a vertically elongated slot or nozzle opening 47, as seen in FIG. 7A. Supply air, SA, in supply conduit 22 can enter the open end 45 (FIG. 1) of tube 37 and move downwardly in the tube to be discharged out slot 47 as indicated by arrows 48 in FIGS. 1 and 7A. The converging walls of tube 37 (along the right hand side of the tube in FIG. 4) combine with elongated slot 47 to produce a nozzle from which the discharging supply air, SA, has increased velocity.

As will be seen in FIGS. 1 and 7A, slotted nozzle opening 47 causes supply air to be discharged into an inverted U-shaped channel 86 having side walls 84 and an open downwardly facing side. Channel 86 can be seen from FIG. 1 to extend transversely across diffuser 21 from an inlet opening 95 to a discharge opening 100. Channel 86 functions as a room air induction channel.

As supply air is discharged from tube 37 through elongated nozzle 47 into room air induction channel 86 in the direction of discharge opening 100, supply air, SA, causes upstream room air, RA, to be drawn or induced to flow into inlet opening 95, as indicated by arrow 96 in FIG. 1. Room air, RA, is pulled from left to right down channel 86 by the high velocity supply air being discharged from nozzle opening 47. As can be seen from FIGS. 1 and 7A, room air, RA, flows around supply air flow tube 37, as indicated by arrows 106, and then the room air is passed downstream to, and is discharged from, opening 100 with the supply air.

It has been found that using an elongated nozzle opening 47, which preferably extends substantially over the full height of channel 86, can induce the flow of considerable room air in air induction channel 86. When as little as 4 cubic feet per minute of supply air volume is being discharged out of nozzle slot 47, the volume of room air induced to flow in channel 86 is sufficient for reproducible room air temperature sensing.

Change-Over Operation

In the form of the VAV diffuser of FIGS. 1–8 damper member 24 is mounted for movement relative to supply air discharge opening 27 by a collar 36 to which damper 24 is secured by fasteners 40. Collar 36 can be extruded from aluminum or plastic, and it can best be seen in FIGS. 1 and 4. The collar is mounted for vertical reciprocation on a vertically extending member, in this case the centrally located supply air flow tube 37.

Carried in vertically extending recessed channels 35 of extruded collar 36 (FIG. 4) are a plurality of roller bearing elements, such as spheres 43, which are mounted on shafts 44 that in turn are press or interference fit into transversely projecting pockets 46. Roller elements 43 cause collar 36 to be supported for smooth, low-friction, rolling movement up and down on supply air flow tube 37.

As best may be seen in FIG. 7A, supply air tube 37 is positioned on a mounting plate 85 which extends between air induction channel flanges 38 and is secured thereto by fasteners 18. Tube 37 is secured to plate 85 by fasteners 124 which threadably engage U-shaped vertically extending channels provided in the interior of extruded tube 37. Fasteners 18 and 124 may be provided, for example, by sheet metal screws or machine screws with a nut secured to the upper side of flange 38. As thus supported, therefore, tube 37 is secured in the approximate center of air induction channel 86 for the flow of room air, RA, around both sides of the tube.

The transversely extending air induction channel 86 is secured to housing 42 by pairs of hanger arms 39 which are secured, for example by fasteners, to each of flanges 38 proximate the opposite ends of channel 86. (Only the hanger arm at the left end of channel 86 is shown in FIG. 1.) As can be seen in FIG. 1, hanger arm 39 extends upwardly to neck 26 and is secured thereto by a fastener 41. Hanger arm 39, therefore, suspend channel 86 in the position shown in FIG. 1 below neck 26, and supply air flow tube 37 is mounted to and supported by mounting plate 85 which is secured to room air induction channel 86.

Figure 7B:
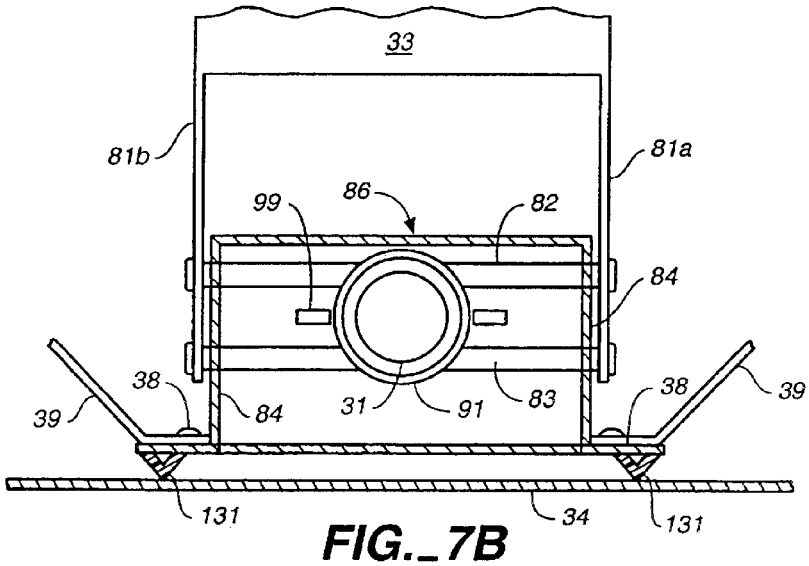
Figure 8:
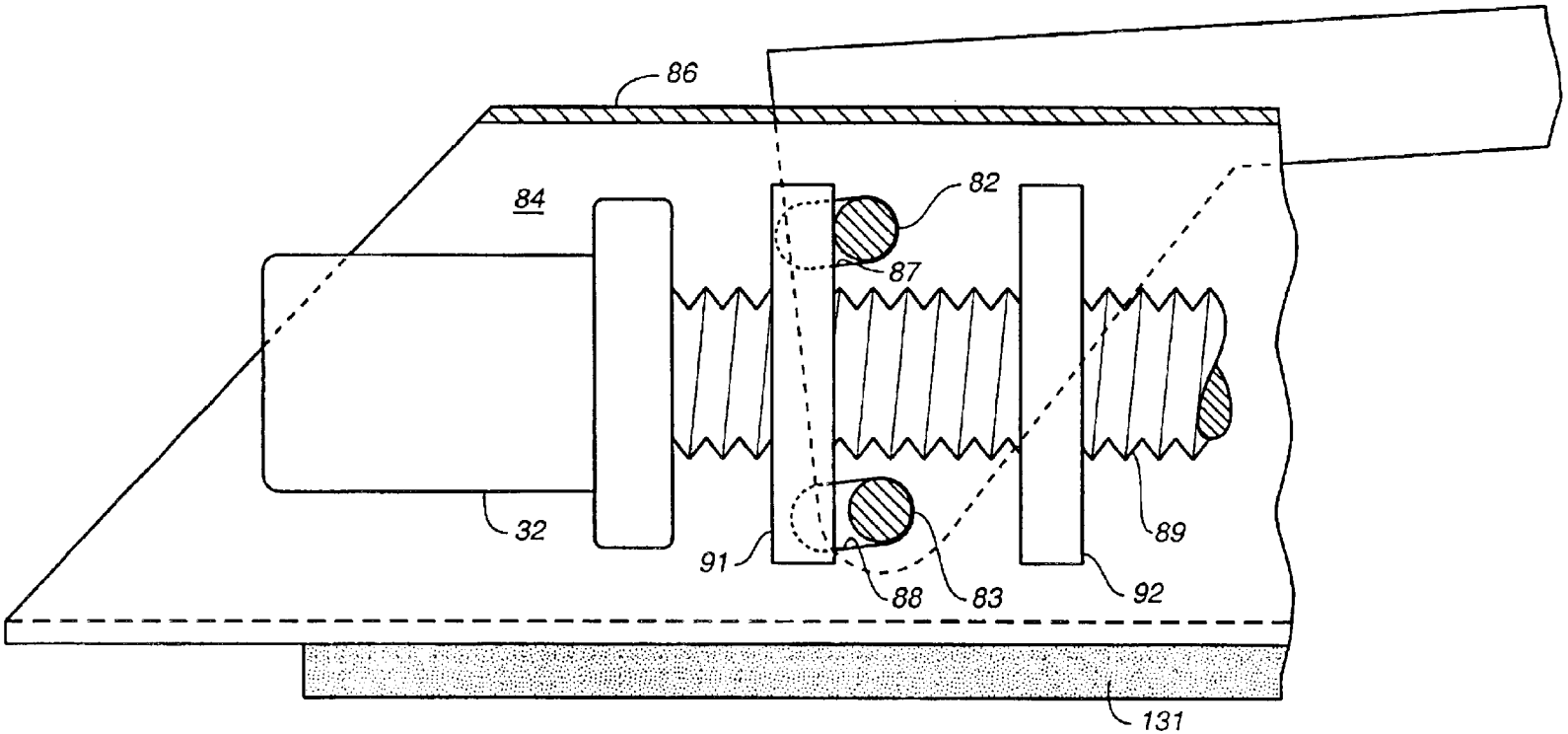
FIG. 8 is a further enlarged, fragmentary, side elevation view of the room air induction channel of the diffuser of FIG. 1 showing the axle pivot slot pattern and the change over linkage.

In order to close the bottom or downwardly facing open side of room air induction channel 86 longitudinally extending resilient sealing strips 131 can be mounted to the lower side of flanges 38 of the room air induction channel. Strips 131 can terminate short of a clip 132 which releasably secures appearance panel 34 to the room air induction channel. Thus, appearance panel 34 provides a bottom wall for air induction channel 86, with resilient strips 131 closing and substantially sealing flanges 38 to the appearance panel. As can be seen in FIG. 7B, strips 131 can advantageously be provided by weather stripping having a V-shaped cross section which is adhesively secured to flanges 38, although inverting strips 131 and securing them to appearance panel 34 also could be done but is less desirable. The seal between the appearance panel and channel 86 does not have to be completely air tight, but the better the seal, the more efficient will be the room air induction function.

As can be seen in FIG. 7A, sealing strips 131 are positioned outside of supply air tube mounting plate 85. This allows appearance panel 34 to be removed from channel 86 by displacing or pivoting it downwardly to expose the entire length of channel 86 except where mounting plate 85 extends across tube 37. By unscrewing fasteners 18 and 124 mounting plate 85 also can be removed from channel 86. This exposes all the damper control elements for maintenance, replacement and repair without the need to remove the diffuser from the ceiling or wall in which it is mounted. Both sensor-actuators 31 and 32 can be accessed, as well as the linkage assembly which displaces the damper member.

Turning now to FIGS. 2A, 2B, 3A and 3B, the supply air sensor-actuator 31 is shown mounted inside supply air flow tube 37 so that supply air, SA, will flow over the wax-containing cylinder 51 of the supply air sensor-actuator, as indicated by arrow 48. Mounted inside cylinder 51 is a rubber diaphragm which is driven by the expanding and contracting wax and which, in turn, drives a piston 52. Thermal sensor-actuators are well known in the industry and are available, for example, through Caltherm Corporation of Bingham Farms, Mich.

A U-shaped bracket 53 is mounted by fastener 54 to the wall of supply air flow tube 37. A piston barrel 56 of sensor-actuator 31 extends through an opening 57 in supply air flow tube 37, which opening is only slightly larger than piston barrel 56 so as to slidably receive piston housing 56 therethrough. Supply air temperature sensor-actuator unit 31, therefore, is supported by tube 37 through opening 57, but is also free to be reciprocated horizontally relative to tube 37.

Figure 2A:
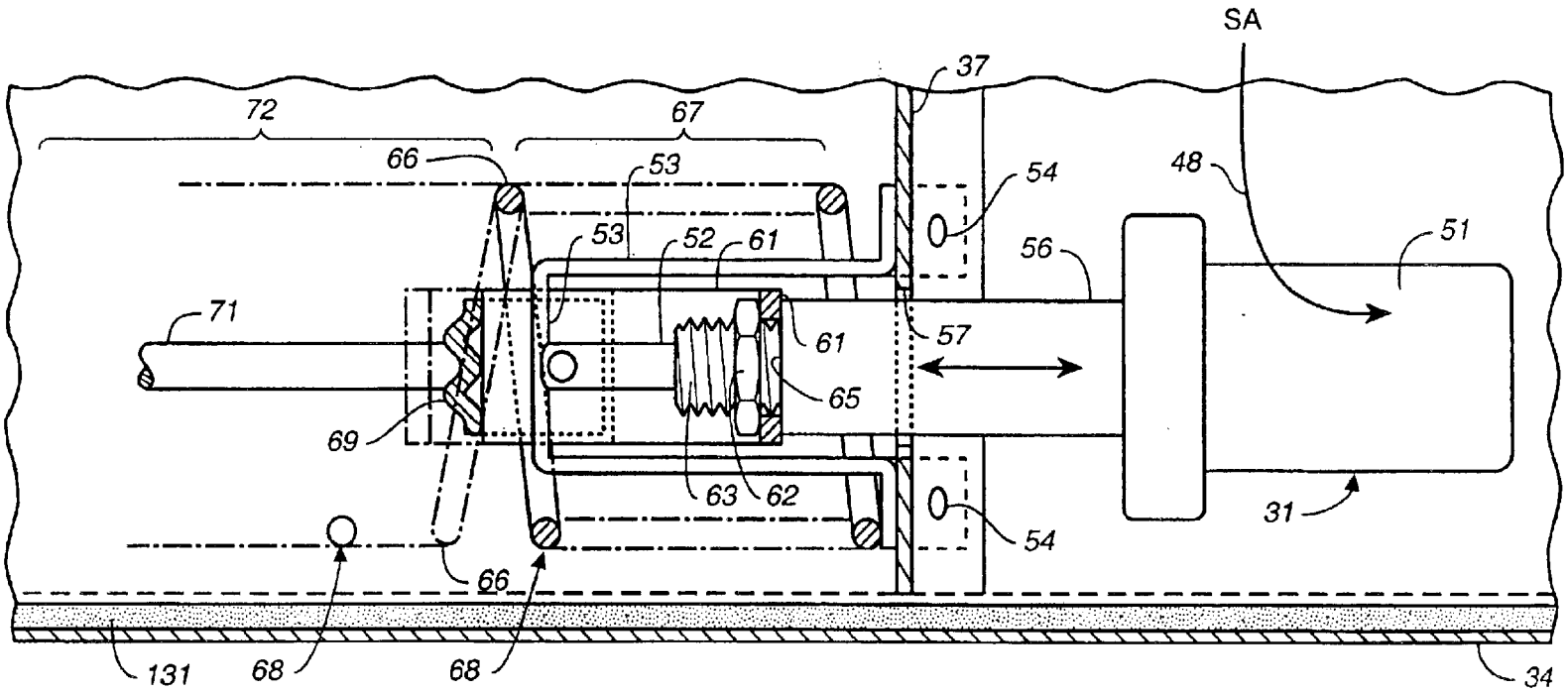
FIGS. 2A and 2B are enlarged, fragmentary, side elevation views of the supply air or change-over sensor-actuator assembly in the heating and cooling modes, respectively.
Figure 2B:
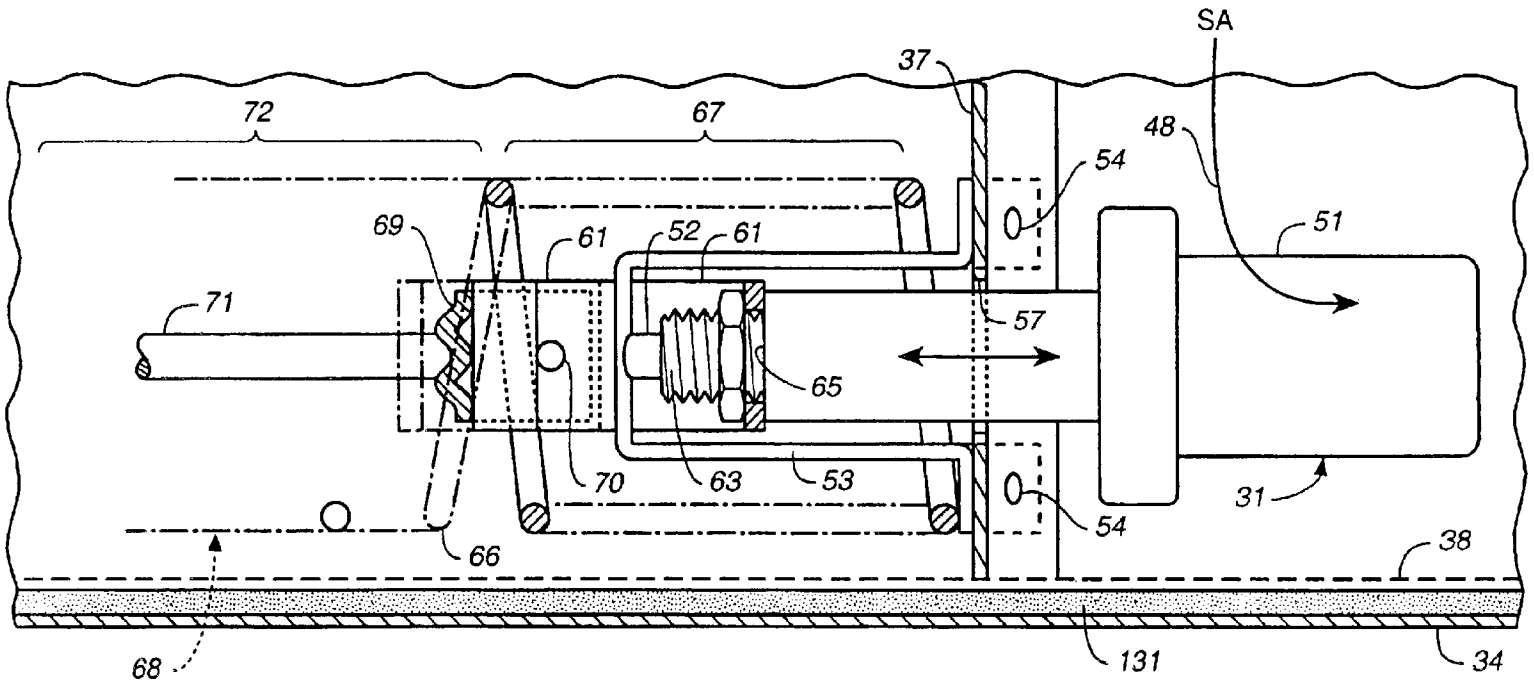
Figure 3A:
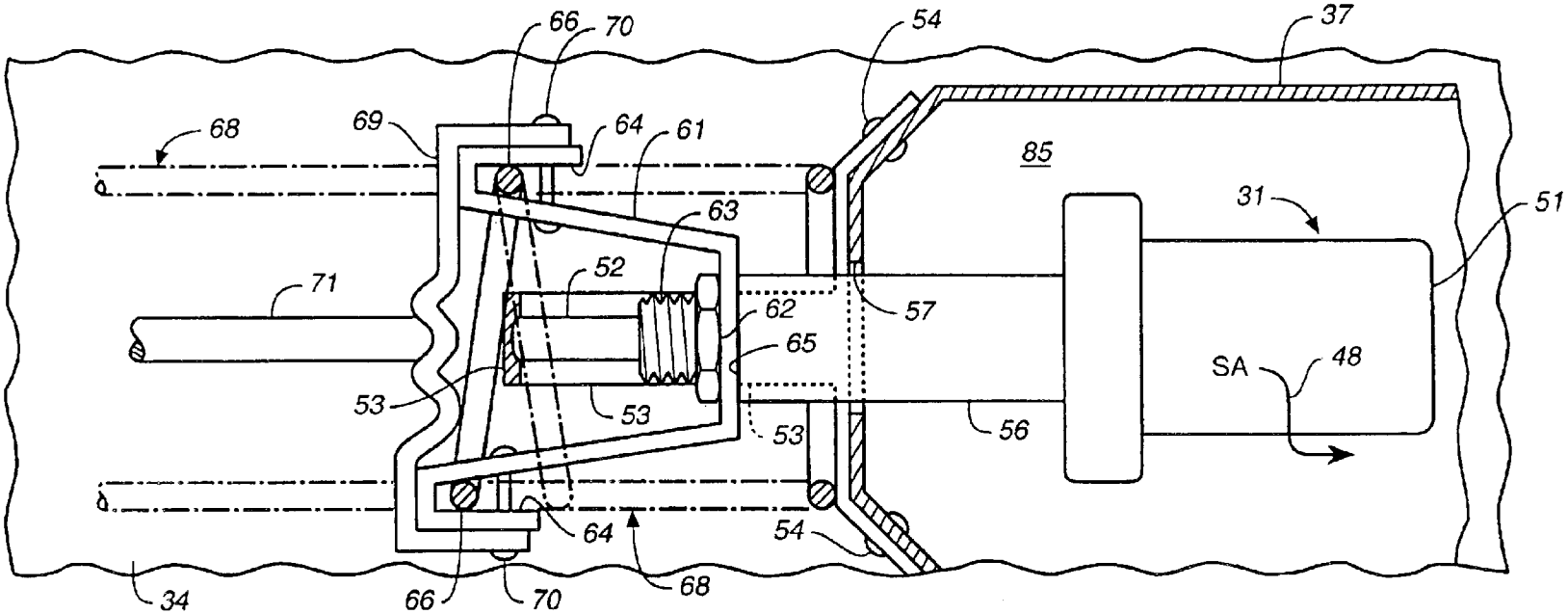
FIGS. 3A and 3B are fragmentary, top plan views of the supply air or change-over sensor-actuator assembly corresponding to FIGS. 2A and 2B.

As will be seen, as piston 52 extends, it pushes on U-shaped bracket 53 and displaces sensor-actuator element 31 to the right relative to supply air tube 37 to the position shown in FIGS. 2A and 3A. When piston 52 retracts into barrel 56, supply air sensor-actuator 31 is biased to move to the left to the position shown in FIGS. 2B and 3B, as will be described below.

Figure 3B:
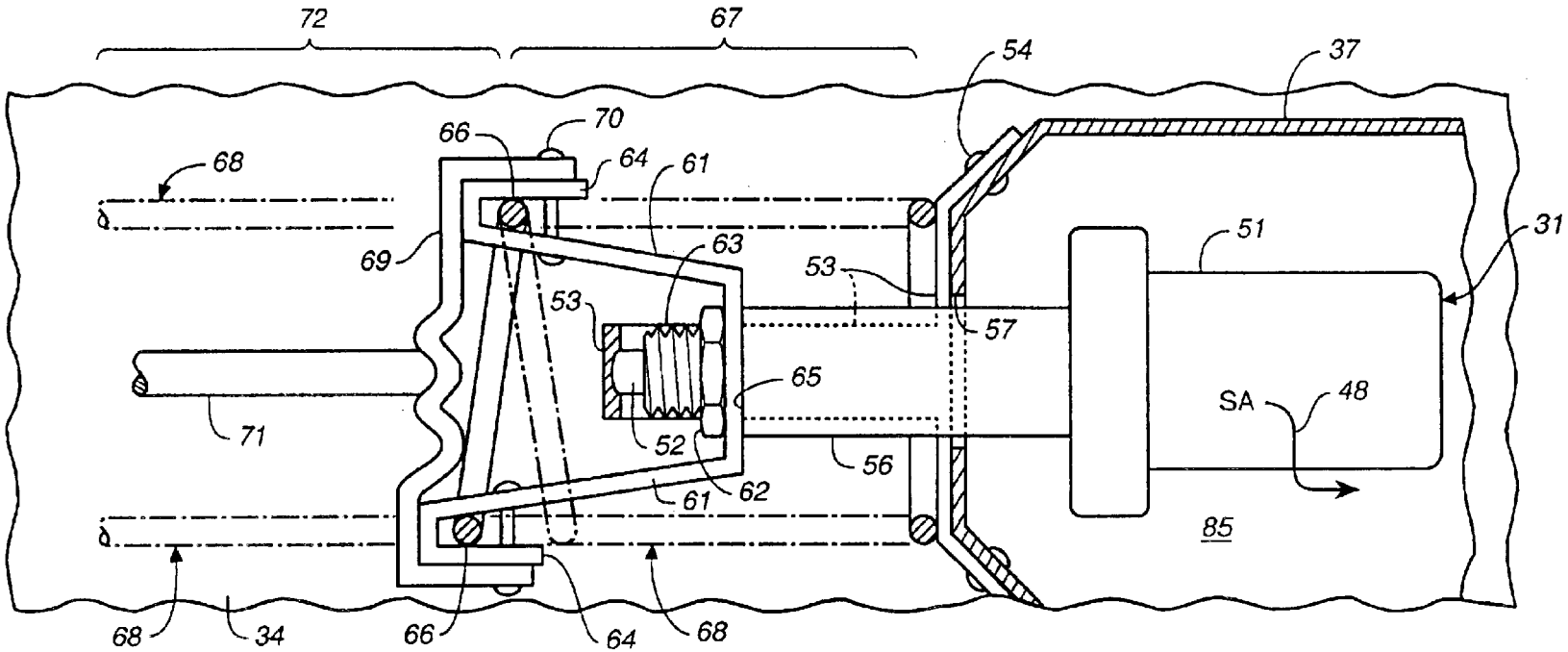

Also coupled to sensor-actuator 31 is a second U-shaped bracket 61, best seen in FIGS. 3A and 3B. Bracket 61 is secured to supply air sensor-actuator 31 by means of a nut 62 threaded on threaded end 63 of the sensor-actuator 31 so as to trap U-shaped bracket 61 against an end shoulder 65 on piston barrel 56. The ends 64 of U-shaped bracket 61 pass around a coil 66 of a coil spring, generally designated 68. Also mounted to U-shaped bracket 61 is a transversely extending drive member 69, which also may be U-shaped and which is secured by a fastener 71 that extends behind coil 66 of spring 68. U-shaped bracket 61 will be seen to be oriented at 90° to U-shaped bracket 53 and bracket 61 spans around the outside of bracket 63, as best seen in FIGS. 3A and 3B. Thus, when supply air sensor-actuator 31 is displaced to the right as piston 52 extends, it pulls U-shaped bracket 61 to the right and carries the transverse drive member 69 to the right against spring 68, which has compression length or segment 67 between coil 66 and supply air flow tube 37.

As member 69 is displaced to the right, a piston 71, extending from room air temperature sensor-actuator 32, and bearing upon drive member 69, also moves to the right under the influence of a tension length or segment 72 of coil spring 68. Tension segment 72 of spring 68 insures that piston 71 and sensor-actuator 32 will follow the displacement of transverse drive member 69, while the compression segment 67 of coil spring 68 biases sensor-actuator element 31 toward the left upon retraction of piston 52 into barrel 56. Winding of coil spring 68 so as to have both compression and tension segments or lengths is well known in the art and will not be described herein.

As shown in FIGS. 2A and 3A, therefore, warm air is flowing in supply air flow tube 37 and sensor-actuator 31 will sense the same and cause piston 52 to extend from end 63 of the sensor-actuator housing. Extension of piston 52 pushes on bracket 53 and produces displacement of supply air temperature sensor-actuator 31 to the right to the positions of FIGS. 2A and 3A. This, in turn, carries the U-shaped bracket member 61 to the right and drive member 69 to the right. Tension spring segment 72 causes the piston 71 and the entire room air temperature sensor-actuator 32 to be displaced to the right in the heating mode when warm supply air is present in supply air flow tube 37.

Referring now to FIGS. 2B and 3B, the position of the various change-over components during the cooling mode can be described. In cooling, the piston 52 of supply air sensor-actuator 31 will be retracted or positioned close to threaded end 63 of the sensor-actuator. Compression segment 67 of coil spring 68 will push U-shaped bracket 61 to the left relative to the supply air flow tube 37, thereby pulling sensor-actuator 31 to the left, which can be clearly seen by comparing FIGS. 2B and 3B with FIGS. 2A and 3A. Tension segment 72 of spring 68 will cause the room air sensor-actuator 32 and its piston 71 to be maintained in contact with the drive member 69, which has been displaced to the left.

Upon change-over to cooling mode, therefore, the room air sensor-actuator 32 is also displaced to the left. Thus, as the supply air temperature changes, the change-over or supply sensor-actuator 31 produces shifting of room air sensor-actuator 32 laterally either to the right or to the left, depending upon the supply air temperature. This change-over shifting is used to enable the room air sensor-actuator 32 to vary the volume of supply air discharged from the diffuser as a function of room air temperature in both heating and cooling modes in a manner which will be described below.

It also should be noted that supply air flow tube 37 provides two functions, namely, it induces the flow of room air in room air induction channel 86 and it provides a supply air flow path below damper 24 in which supply air sensor actuator 31 can be positioned for easy access.

Air Volume Control

Heating Mode

Figure 5A:
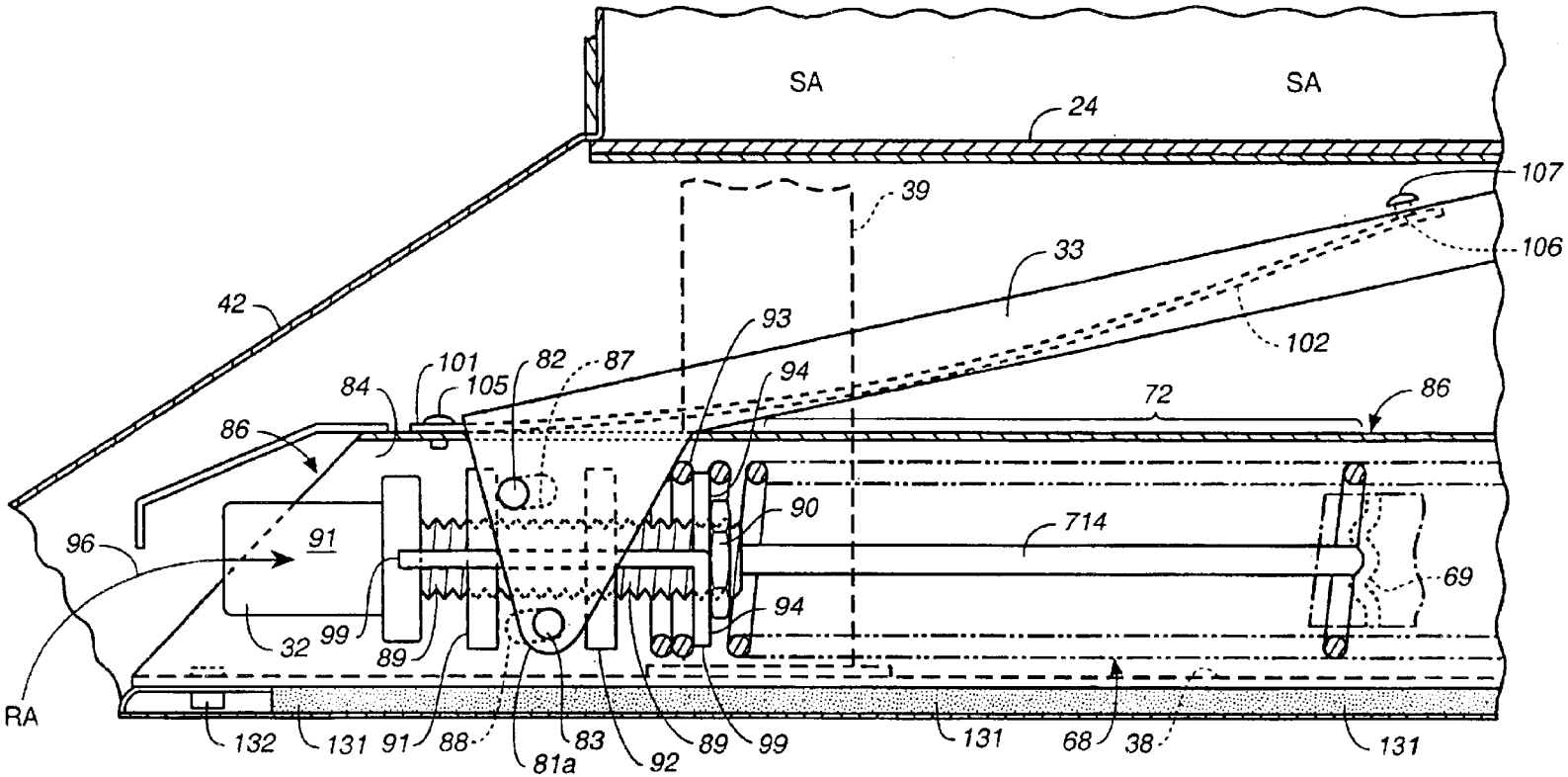
FIGS. 5A–5D are enlarged, fragmentary, side elevation views of the room air sensor-actuator and the associated linkage assembly of the diffuser of FIG. 1, showing movement of the diffuser damper for VAV operation in both heating and cooling modes.
Figure 5B:
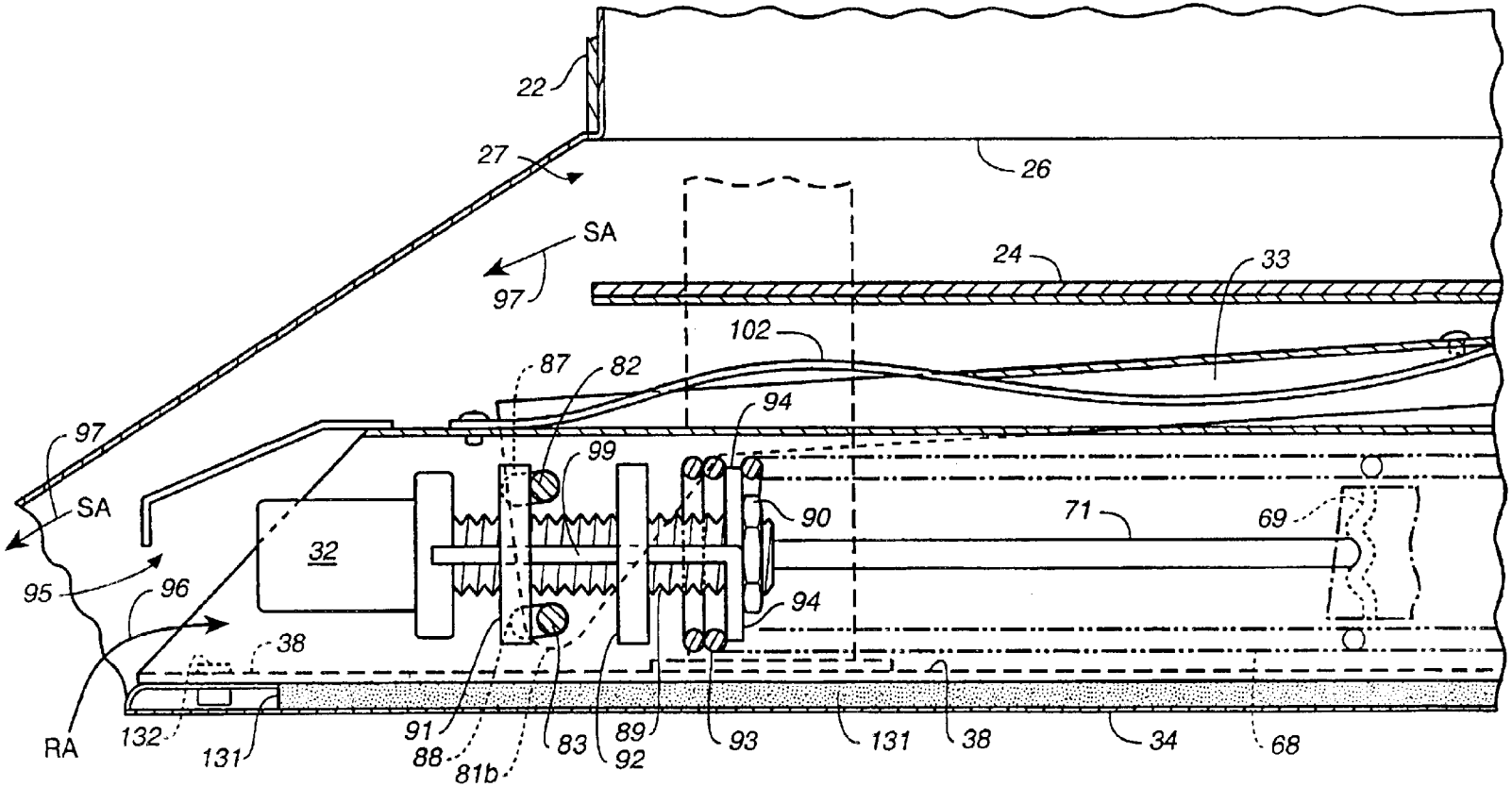

FIGS. 5A and 5B illustrate variation of the air volume discharged from the diffuser when change-over sensor-actuator 31 is in the heating mode or the far right position shown in FIGS. 2A and 3A.

Figure 5C:
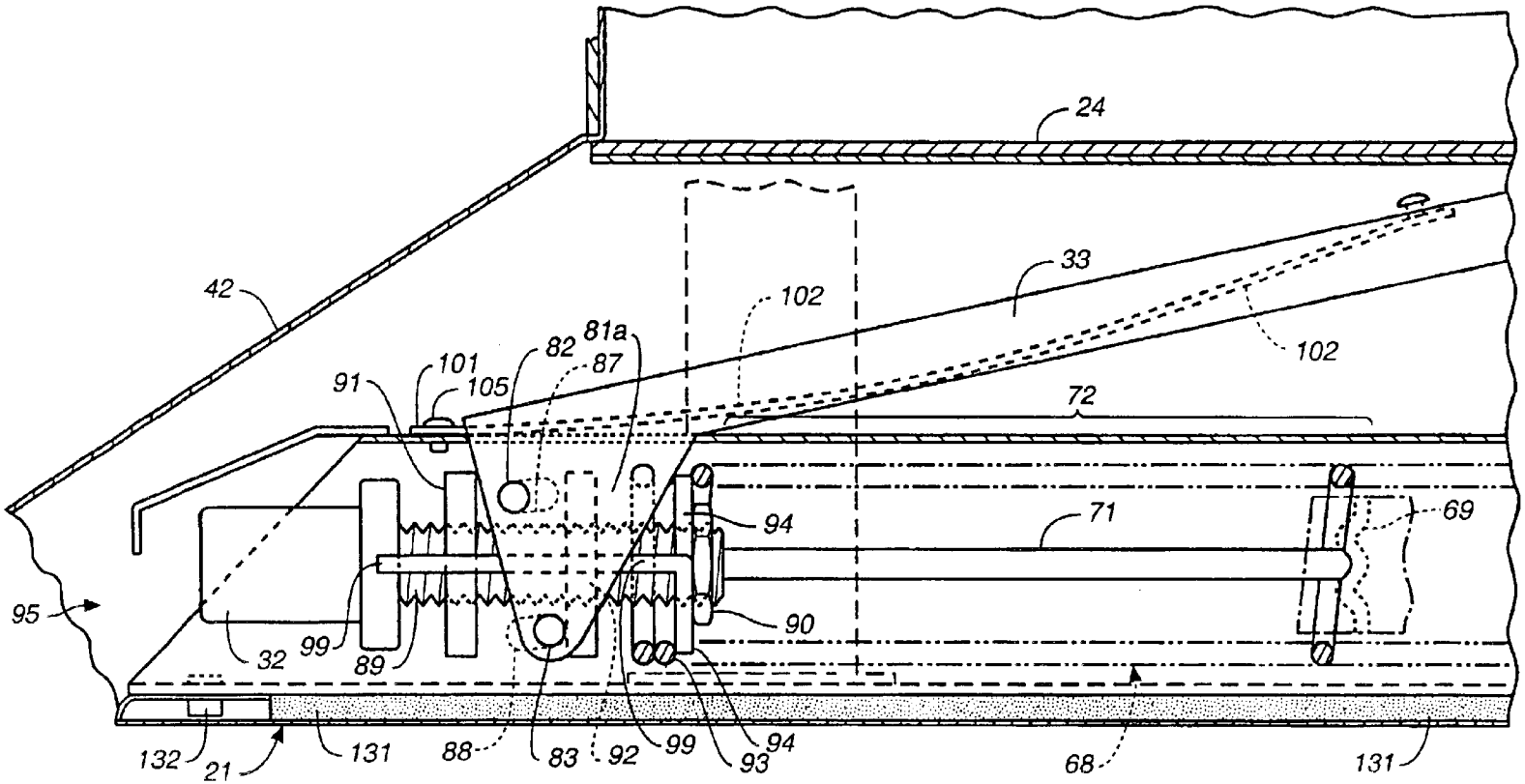
Figure 5D:
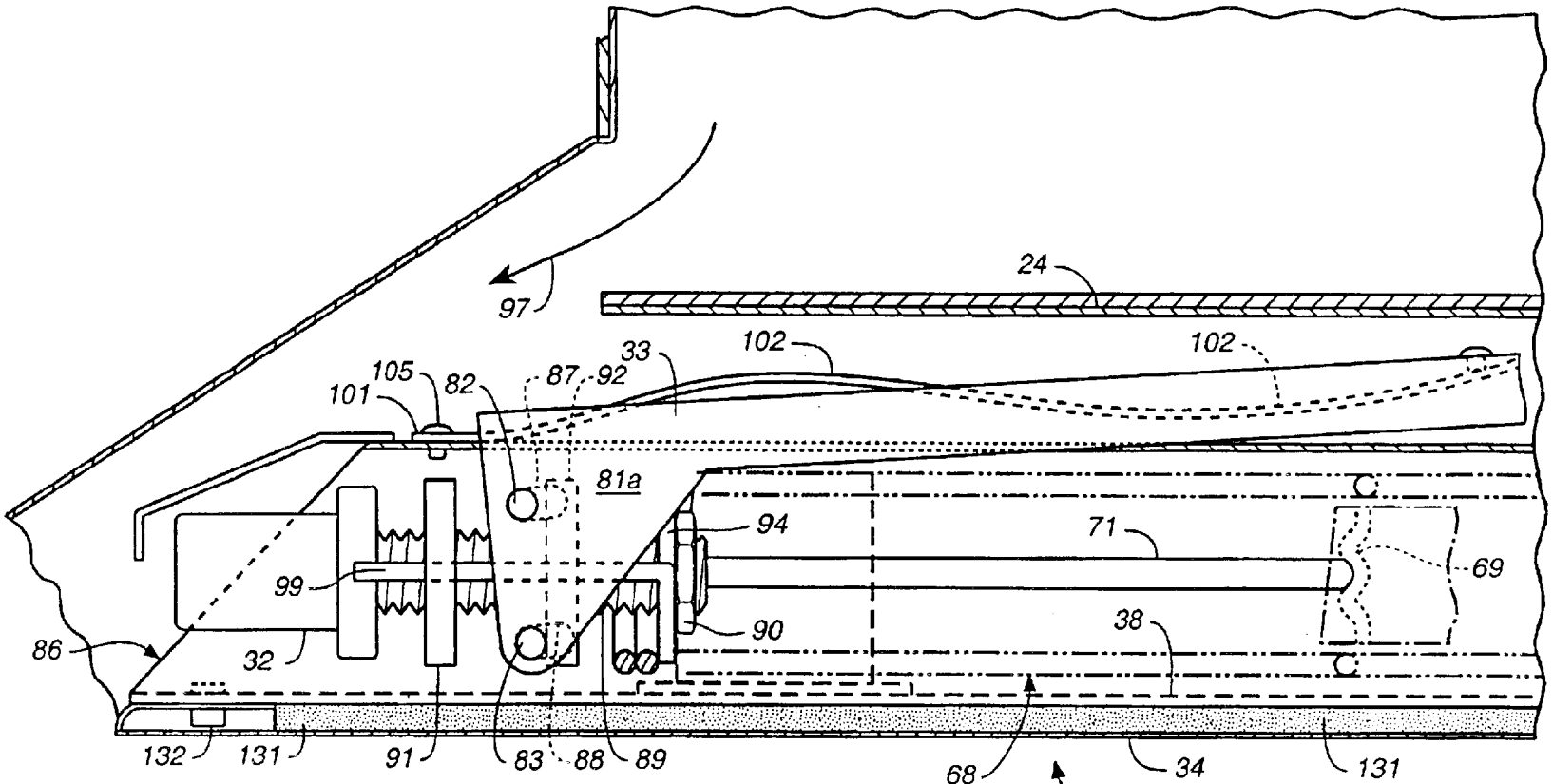
Figure 6:
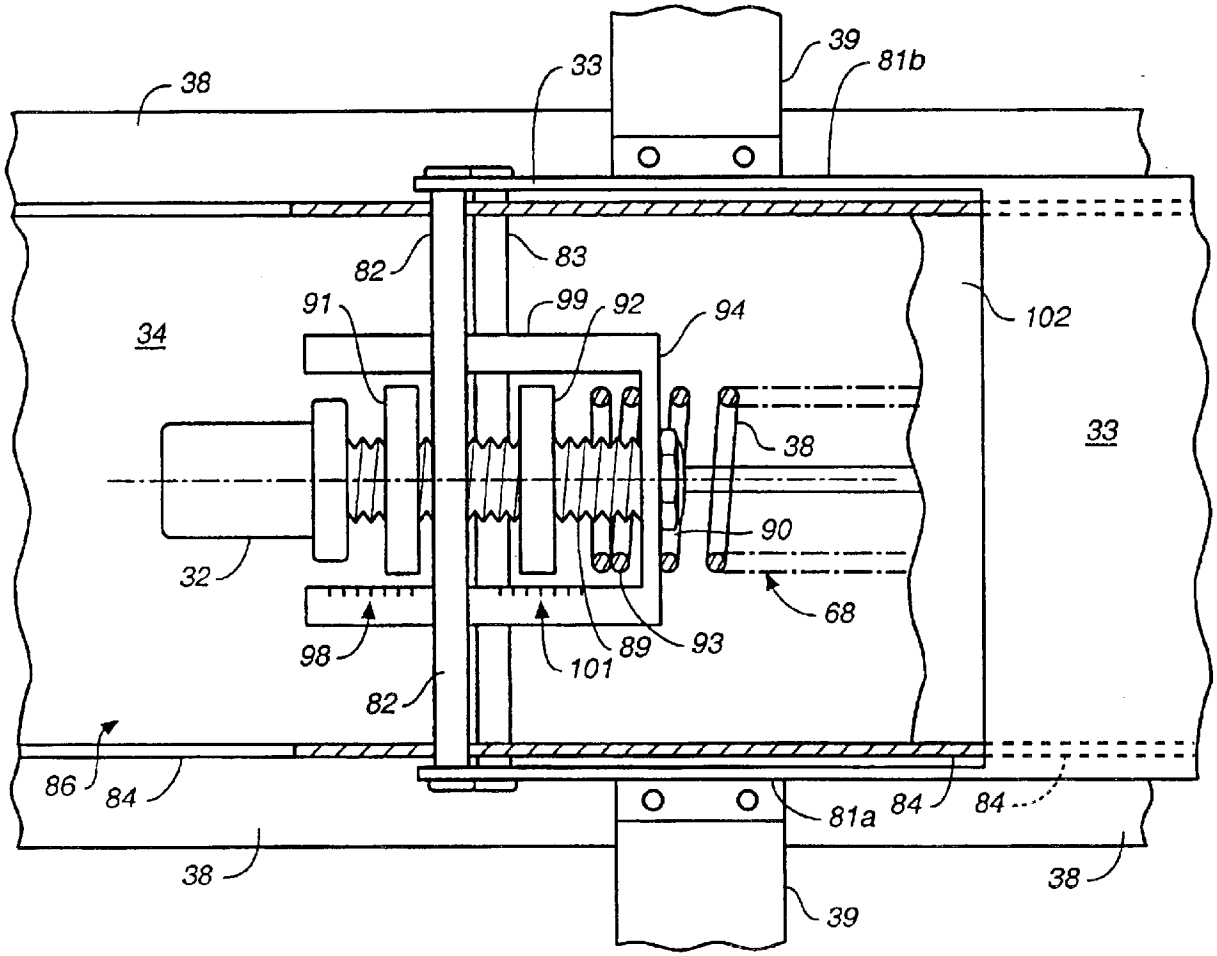
FIG. 6 is an enlarged, fragmentary, top plan view of the room air sensor-actuator and room air induction channel of the diffuser assembly of FIG. 1.

In the illustrated embodiment of the VAV diffuser of the present invention, damper 24 is raised and lowered on supply air flow tube 37 by lever 33. Lever 33 can be seen to be mounted by downwardly depending lever ends 81*a* and 81*b*, which are triangular and can be seen from FIG. 7B to span over and be mounted to the outside wall 84 of room air induction channel 86. In FIGS. 5A, 5C and 5D, the right hand (FIG. 7B) lever end 81*a* is shown, while in FIG. 5B lever end 81*a* is removed for clarity and left hand lever end 81*b* is shown in broken lines behind far wall 84. Ends 81*a* and 81*b* of lever 33 are pivoted about two pivot points by two transversely extending rods or axles 82 and 83. Axles 82 and 83 extend between side walls 84 of room air induction channel 86, as best can be seen in FIGS. 6 and 7B. Side walls 84 of air induction channel 86 include arcuate slots 87 and 88 (FIG. 8) which slidably receive the ends of rods or axles 82 and 83. Extending between rods 82 and 83 is a threaded elongated end 89 of room air temperature sensor-actuator 32, out of which piston 71 extends.

Two temperature set point thumb wheels 91 and 92 are threadably mounted on end 89 of the room air temperature sensor-actuator. Wheels 91 and 92 can be adjusted along the length of the threaded end 89 by turning them on end 89 so as to adjust the room air temperature set points at which damper 24 will open to allow the discharge of supply air from the diffuser. End coil 93 of spring 68 is coupled to move with the end 89 of the sensor-actuator by a nut 90 and a vertically extending flange 94 of U-shaped member 99 (FIG. 6). The tension segment 72 of spring 68 pulls coil 93 to the right against vertical flange 94, which is held on sensor-actuator threaded end 89 by nut 90.

Operation of room air sensor-actuator 32 to open damper 24 can now be described. As will be seen in FIG. 5A, lower transverse axle 83 is at the far right-hand end of elongated slot 88 and upper transverse axle is at the far left hand end of upper slot 87. This results because lever 33 is biased in a counterclockwise direction by arcuate leaf spring 102. End 101 of leaf spring 102 is fastened by fastener 105 to the top wall of air induction channel 86. Opposite end 106 of spring 102 slides on a fastener 107 protruding through lever 33 so as to minimize the area in sliding contact.

In an unconstrained state spring 102 would curve upwardly in a smaller radius than shown in FIG. 5A, and thus spring 102 biases lever 33 in a counterclockwise direction to lift damper 24 upwardly against the weight of the lever and the static pressure of the supply air in conduit 22. Counterclockwise rotation of lever ends 81*a*, 81*b* urges lower axle 83 to the right end of slot 88 and upper axle 87 to the left end of slot 87.

In FIG. 5A the room air temperature is relatively warm and room air flowing past sensor-actuator 32, as indicated by arrow 96, will cause piston 71 to be extended from threaded end 89 of the sensor-actuator. When hot air is in the supply air flow tube 37, and the room is warm, therefore, damper 24 will be biased closed by spring 102, as shown in FIG. 5A, and the warm supply air will not escape or be discharged into the room.

As will be described in detail below, the "closed" position of damper 24 may not be as shown in FIGS. 1, 5A and 5C. Instead, it is preferred in most applications that the diffuser always allows some minimum flow of supply air to discharge out of opening 27. Thus, in the "closed position" shown in the embodiment of FIG. 9, supply air, SA, will escape or flow into the room or space being temperature controlled. It will be understood, therefore, that the "closed" position of FIG. 5A could also stop short of fully closing opening 27. One of the reasons for always providing for supply air flow from the diffuser, even though the set point temperature has been reached, is to provide room ventilation. The supply often will contain outside or "resh" as a part (e.g. 20%) of the supply air. Thus, in many buildings this ventilation function of the supply air (in addition to the heating and cooling functions) is very important to maintain. Otherwise, merely recycling air drawn from the rooms through return conduits tends to result in some degree of staleness, even though the returned air is filtered.

As the room begins to cool, piston 71 will be retracted relative to the end 89 of room air sensor-actuator 32. As it retracts, tension segment 72 of spring 68 pulls room air sensor-actuator 32 to the right from the position shown in FIG. 5A, which causes thumb wheel 91 to begin to displace upper axle 82 to the right in slot 87 so as to pivot arm 33 clockwise about lower axle 83, which is at the far right end of lower slot 88. As the room gets cooler and cooler, thumb wheel 91 causes pivoting of lever 33 about lower rod or axle 83 to the position shown in FIG. 5B. Such clockwise pivoting of lever 33 allows damper 24 to move to a lowered position, permitting the discharge of supply air, SA, out annular discharge opening 27 and out of the diffuser, as shown by arrows 97 in FIG. 5B. Warm air will continue to discharge into the room until the room air temperature begins to rise. As the room air temperature begins to rise and that temperature change is sensed by sensor-actuator 32, piston 71 extends from sensor-actuator 32 and drives sensor-actuator 32 to the left, moving thumb wheel 91 to the left in slot 87. This allows counterclockwise pivoting of lever 33 back toward the position in FIG. 5A under the influence of leaf spring 102. Damper 24 is again lifted to the closed position (either as shown in FIG. 5A or in FIG. 9).

The temperature at which damper 24 is opened by pivoting lever 33 will depend upon the position of thumb wheel 91 along the length of threaded end 89 of the room air temperature sensor-actuator. The set point temperature at which damper 24 opens or closes in the heating mode, therefore, can be set by the user by merely adjusting or screwing thumb wheel 91 along threaded actuator end 89. As can be seen FIG. 6, a temperature set point scale 98 can be provided on U-shaped member 99, with the scale being calibrated at the factory. Scale 98 is shown in FIG. 6 on the upwardly facing side of member 99, but it will be appreciated that the scale will, in fact, be on the downwardly facing side of member 99 so that the user can see it easily upon removal of appearance panel 34. The user may remove or pivot down appearance panel 34 and then use scale 98 to adjust the position of thumb wheel 91 to suit the user's desired operating criteria.

Once the mode of operation of the diffuser has been determined by change-over sensor-actuator 31, therefore, the room air temperature sensor-actuator 32 modulates the position of damper 24 so that increased thermal demand (a cool room) causes opening of the damper, while decreased thermal demand (a hot room) results in a closing of the damper.

Change Over

FIG. 5B illustrates the position of sensor-actuator 32 and thumb wheels 91 and 92 when warm or hot supply air is present in conduit 22 and supply air flow tube 37. When the supply air source is changed over to provide cool air to supply air conduit 22, the result is that sensor-actuator 31 senses the cool air in supply air flow tube 37 and moves from the FIG. 2A/3A position to the FIG. 2B/3B position. This, in turn, results in sensor-actuator 32 and thumb wheels 91 and 92 being pushed to the left from the FIG. 5B position to the FIG. 5C position. As thumb wheel 91 moves left, lever arm 33 pivots in a counterclockwise direction under the influence of leaf spring 102, which lifts damper 24 to the closed position.

It is an important feature of the present invention that during a change over of modes, from heating to cooling or from cooling to heating, that damper 24 moves to the closed position. This enables future opening of the damper to be controlled by room air sensor-actuator 32 for both heating and cooling modes. Thus, damper 24 is not left open after a change over from heating to cooling when the room temperature is 65° F. and cool air is present in supply conduit 22. If the supply air set point, or damper opening temperature, is 78° F. in cooling mode and the room is a 65° F., cool air should not be discharged into the room, which is already cooler than the temperature set point (78° F.) at which cooling should start.

The change over from cooling to heating also results in damper 24 being moved to the closed position. Thus, when supply air sensor-actuator 31 moves from the FIG. 2B/3B position to the FIG. 2A/3A position, sensor-actuator 32 and thumb wheel 92 are moved to the right from the FIG. 5D position to the FIG. 5A position. Thumb wheel 92, therefore again allows axle 83 and lever 33 to pivot counterclockwise about axle 82 and the damper is lifted to the "closed" position by the lever (which, as above noted, need not be entirely closed).

Cooling Mode

Cooling mode operation can be understood by reference to FIGS. 5C and 5D. In the cooling mode the change-over sensor-actuator 31 will be in a far left position, which will allow the transverse drive member 69 against which piston 71 bears to be in a far left position. This causes room air sensor-actuator 32 to move to the left. Leaf spring 102 will pivot lever 33 in a counterclockwise direction until axle 82 is in the far left end of slot 87 and axle 83 is in the far right end of slot 88. This is essentially the same position as FIG. 5A, but in the cooling mode thumb wheel 92 is now closely proximate or touching down axle 83 (instead of having thumb wheel 91 closely proximate or engaging upper axle 82, as is the case for the heating mode).

In the condition illustrated in FIG. 5C, the room air temperature flowing over room air sensor-actuator 32 is relatively cool, which means that piston 71 is retracted and sensor-actuator assembly 32 is pulled to the right by tension length 72 of spring 68. As the room air temperature increases, piston 71 extends, pushing sensor-actuator 32 to the left. The cooling set point temperature thumb wheel 92 begins to engage lower transverse rod or axle 83 and pivots lever arm 33 in a clockwise direction about upper rod or axle 82, which is at the far left end of slot 87. This causes lowering of damper 24 to the position shown in FIG. 5D.

As the room air temperature drops by reason of discharge of cool air from the diffuser into the room, the room air induced to flow past sensor-actuator 32 cools and contracts the wax and piston 71 is retracted into end 89 of sensor-actuator 32. The tension segment 72 of spring 68 pulls sensor-actuator to the right as piston 71 retracts, which in turn pivots lever 33 in a counterclockwise direction to "close" damper 24 so as not to over cool the room.

As will be seen, therefore, by providing two pivot points for arm 33 and using change-over sensor-actuator 31 to shift thumb wheels 91 and 92 to engage axles 82 and 83 on opposite sides of the axles, damper control lever arm 33 can be pivoted in the same directions (clockwise to open and counterclockwise to close the damper) for both heating and cooling modes. This two-pivot approach allows simplification of the linkage assembly and the use of only two sensor-actuators to achieve VAV operation in both modes with independently adjustable temperature set points in each mode.

The user can set the temperature set point for opening and closing of damper 24 in the cooling mode by rotating the temperature set point thumb wheel 92 on threaded end 89 of sensor-actuator 32. A cooling mode temperature scale 101 (FIG. 6) also can be provided on the U-shaped member 99 to guide user in setting the cooling mode temperature set point. Obviously, the two set points, namely the cooling mode temperature set point and the heating mode temperature set point, can be independently adjusted by positioning thumb wheels 91 and 92 along the threaded barrel 89 of room air sensor-actuator 32. By way of example, the heating mode temperature set point might be 70° F., while the cooling mode temperature set point might be 78° F. The two temperature set points, however, could be the same temperature, although that is not usually the case.

Second Embodiment

Turning now to the alternative embodiment of the diffuser of the present invention as shown in FIGS. 9–12, a diffuser 221 is provided which is constructed in a manner similar to that of diffuser 21, except that a somewhat different control assembly 228 is provided.

Supply air flow tube 237 again has a supply air sensor-actuator 231 mounted in it. Sensor-actuator 231, however, is fixedly mounted to tube wall 240 so that the body of sensor-actuator 231 does not move. Piston 271 of supply air or change-over sensor-actuator 231, however, does move to the left in FIG. 9 relative to wall 240 when warm air is in tube 237 and moves to the right when cool air is present in supply air flow tube 237.

Figure 12:
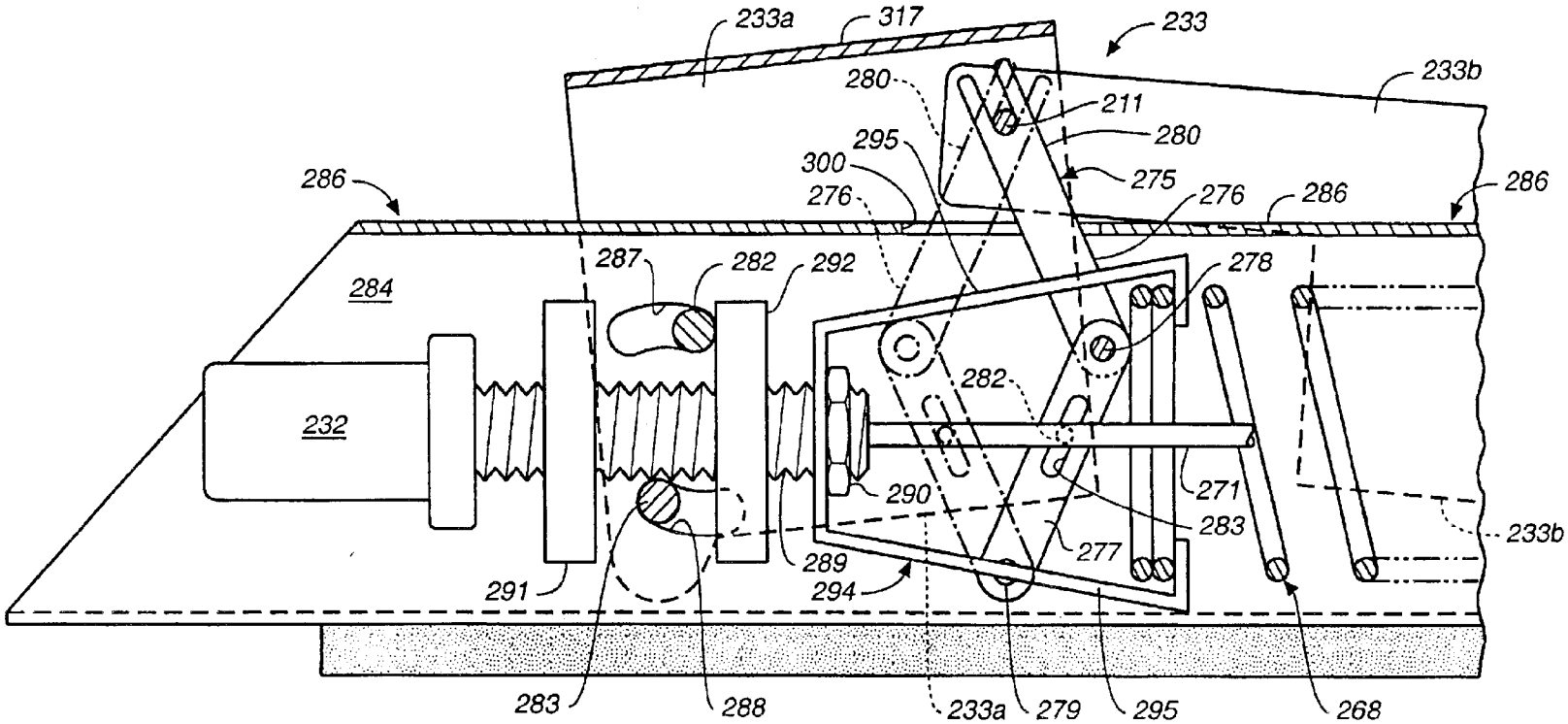
FIG. 12 is a further enlarged, fragmentary side elevation view of the alternative embodiment corresponding to FIG. 8.

A tension (only) spring 268 is coupled at one end by plate or washer 250 and nut 262 on the end 263 of sensor-actuator 231. The opposite end of tension spring 268 is coupled by a spring gripping member 294 having four fingers 295 which are positioned in pairs of fingers on either side of piston 271 (FIG. 12). Nut 290 is mounted on end 289 of a room air sensor-actuator 232 to hold spring gripping member 294 to end 289 of actuator 231. Piston 271 of the change-over sensor-actuator 231 preferably also extends into barrel end 289 of room air sensor-actuator 232 so that a common piston 271 is used for both change-over displacement and room air based damper displacement. As will be appreciated, piston 271 need not be monolithic, that is, a change-over piston could be coupled by a sleeve to the room air piston or the change-over piston and room air pistons could be in end-to-end abutting relation in either of the barrels of the sensor-actuators.

As will be appreciated, when piston 271 extends or retracts sensor-actuator 232 is displaced to the right or left. When displaced to the left (the first dotted line position of sensor-actuator 232 in FIG. 9) the diffuser is in the heating mode, and if warm room air is being sensed by room air sensor-actuator 232, piston 271 also is extended out of sensor-actuator 232 and the room air sensor actuator is displaced to its farthest left position (the second dotted line position of FIG. 9).

In the diffuser and control assembly shown in FIGS. 9–12, the damper displacing arm 233 is gravity biased to a downward position and the thumb wheels 291 and 292 are reversed in their control of heating and cooling modes. Referring to FIG. 12, it will be seen that lever arm 233 is in a lowered position proximate the top of room air induction channel 286. As so gravity biased, upper axle 282 is at the right hand end of arcuate slot 287 in side wall 284, and lower axle 283 is at the left end of arcuate slot 288.

When change-over sensor-actuator 231 displaces room air temperature sensor-actuator 232 to the left, thumb wheel 292 comes into close proximity to, or engages, axle 282. If the room air temperature sensed by actuator 232 is cool, piston 271 will be retracted into sensor-actuator 232 (moving the sensor-actuator to the right) and lever arm 233 will be lowered. As the room heats up, piston 271 extends, driving sensor-actuator 232 and thumb wheel 292 to the left in FIG. 12 and pivoting arm 233 in a counterclockwise direction about lower axle 283, which is at the left end of lower slot 283. This in turn lifts the arm and damper 224 to the "closed" position shown in FIG. 9.

When the room cools down, piston 271 retracts and heating mode thumb wheel 292 moves to the right allowing the arm 233 to be gravity and pressure biased toward an open position, allowing more warm supply air to be discharged from the diffuser.

Figure 9:
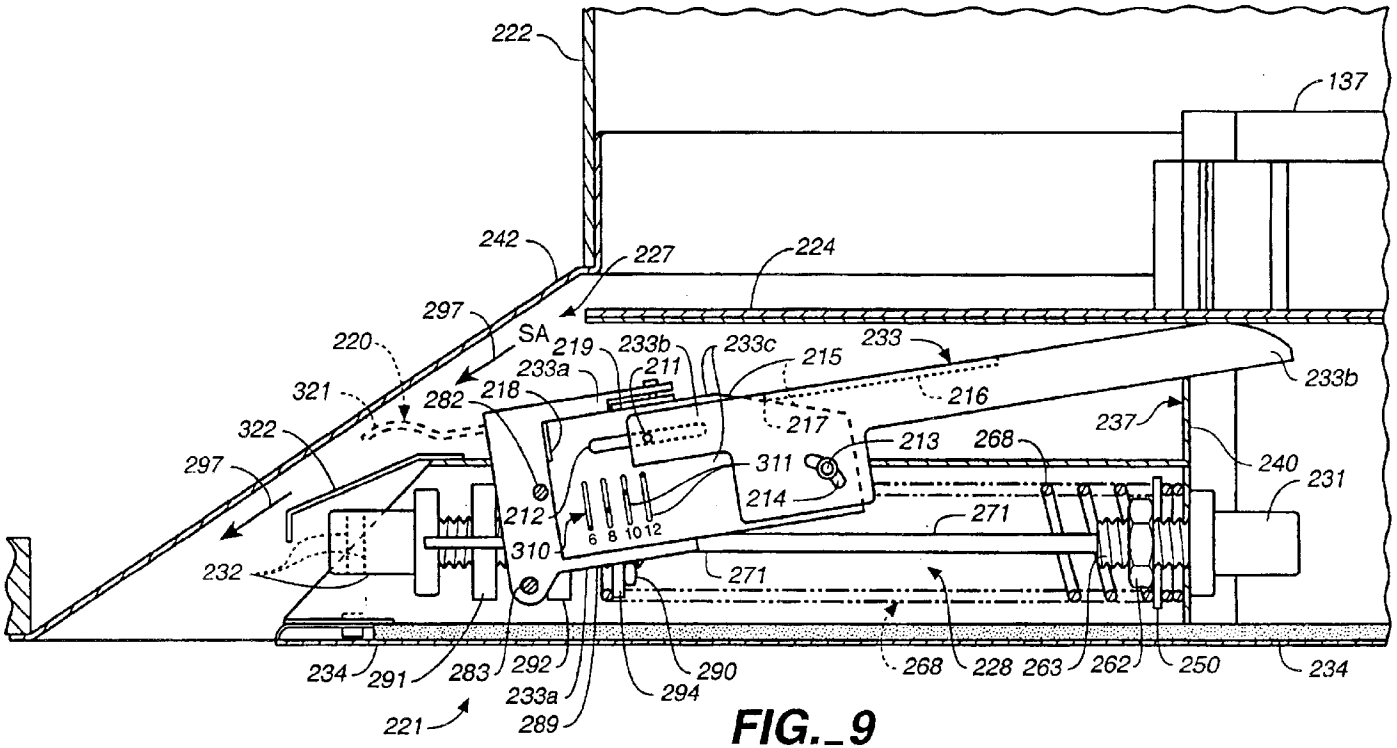
FIG. 9 is a fragmentary, side elevation view, corresponding to FIG. 1, of an alternative embodiment of a VAV diffuser constructed in accordance with the present invention.

In the cooling mode, piston 252 retracts and tension spring 268 pulls sensor-actuator 232 and temperature set point thumb wheels 291 and 292 to the right from the position shown in FIGS. 9 and 12. This causes cool mode temperature set point thumb wheel to be brought into close proximity with or engage lower axle 283.

If the room air temperature sensed by sensor-actuator is cool piston 271 will be retracted into sensor actuator 232 and cooling mode thumb wheel 291 and sensor-actuator 232 are pulled by spring 268 to the right so as to pivot lower axle 283 counterclockwise about upper axle 282 and move damper 224 toward the "closed" position so as to reduce the amount of cool air discharged into the room. As the room heats up, piston 271 extends from sensor-actuator 232 and gravity and supply air pressure bias the damper open as sensor-actuator 232 cooling mode thumb wheel 291 move to the left.

Again, diffuser control device 228 is constructed with two pivot axes and the damper control lever is rotated about one axle or axis in heating mode and the other axis in cooling mode.

As will be seen, the embodiment of FIGS. 9–12 has a simplified change-over structure and therefore is somewhat preferable as compared to the embodiment of FIGS. 1–8 in terms of manufacturing and assembly costs. Both approaches operate to allow independent setting of the cooling mode set point temperature and the heating mode set point temperature and require only two thermal sensor-actuator assemblies.

In the embodiment of FIGS. 9–12, damper 224 will not necessarily move to the "closed" position because it is gravity and pressure biased to an open position. As above-noted, it is desirable for the diffuser to close whenever a change-over occurs. In the embodiment of FIGS. 9–12, this can be accomplished by providing a change-over linkage, generally designated 275 and shown in FIG. 12.

Change-over linkage 275 can take the form of two link members 276 and 277 that are pivoted together at 278 and pivoted at 279 to the room air induction channel 286 and coupled to lever 233 by a slotted or forked end 280 which slidably and rotatably engages pin 211 provided on lever arm 233. A coupling to piston 271 is provided, which may take the form of a pin 282 which slides in slot 283. Linkage 275 is positioned inside spring gripping member 294 at about the center of air induction channel and is attached to pivot pin 211 at about the transverse mid-point of pin 211 through a slot 300 in the top wall of channel 286. Slot 300 includes a wiper skirt (not shown) to minimize leakage of non-room air into channel 286. Linkage 275, therefore, is essentially an over center type of linkage which pushes damper control arm 233 upward as the linkage coupling is moved right or left across a center line by change-over sensor actuator 231. This linkage insures that the damper will move to a "closed" position during each change over.

It is important to note that change-over linkage 275 is pivoted about pin 211, which is the pin that lever arm member **233*b* pivots about when balancing the system, as described below. Thus, change-over linkage 275 does not interfere with dropping arm member 233*b* and damper 224** to the fully open position during balancing.

Minimum Flow Stop Assembly

As noted above, in many applications it is highly desirable that the diffuser damper does not move to a closed position completely closing discharge opening 27. As shown in FIG. 9, damper member 224 is displaced upwardly as far as is possible, that is, to a "closed" position by lever arm 233, given the configuration of lever arm 233. Supply air, SA, is still discharged out opening 227 between damper 224 and wall 242, as indicated by arrow 297, in this closed position.

Lever arm 233, in the embodiment of FIGS. 9–12, is a compound lever arm comprised of several arm components which enable the user to selectively adjust the minimum flow stop or "closed" position of the damper. Thus, movable linkage assembly 228 includes a compound control lever 233 having an arm base member **233*a* to which axles 282 and 283 are mounted, a damper engaging arm member 233*b* and an intermediate minimum flow adjustment member 233*c***.

Compound lever arm can be selectively adjusted by the user in order to set the "closed" position of the diffuser anywhere from fully closed (FIG. 1) to a position enabling a substantial volume of air to discharge from the diffuser. Base arm member **233*a* is pivotally mounted and driven by thumb wheels 291 and 292 in a manner as described above. Base arm member 233*a* essentially travels through the same range of motion as arm 33 in the embodiment of FIGS. 1–8, but adjustment member or slider 233*c* can be used to change the relative angle of damper engaging member 233*b* to base arm member 233*a***, that is, the configuration of the compound arm.

The inner end of damper engaging arm member **233*b* is rotatably pinned by transverse axle or pin 211 to base arm member 233***a*. Intermediate adjustment or slider member 233*c*, however, include an elongated slot 212 which slides over pin 211. Moreover, adjustment member 233*c* caries a wing nut 213 which extends through an arcuate slot 214 in damper engaging arm member 233*b*. A ramp surface 215 of slider 233*c* is downwardly sloped and supports a transversely extending portion 216 of the damper engaging arm member 233*c* at position 217.

The configuration of compound arm 233 can be adjusted as follows. Wing nut 213 can be loosened permitting slider member 233*c* to be moved right or left relative to base arm member 233*a* and damper engaging arm member 233*b*. As adjustment member 233*c* is urged to the right, using manually grippable ear 218, ramp 215 pushes against transverse surface 216 and tends to straighten out the compound lever, causing it to move damper 224 to a more elevated "closed" position. As adjustment slider 233*c* is moved to the left, transverse portion 216 move and contact point 217 down ramp surface 215, and the compound arm "breaks" more or has a greater downward angle between base arm member 233*a* and damper engaging member 233*b*. This results in a lowering of damper 224 in its uppermost or "closed" position, which, in turn, allows more supply air to be discharged from the diffuser in the closed position. Rotation of slider 233*c* about pin 211 is not possible because a lever end 219 extends transversely over a top edge of adjustment member 233*c*.

Once the desired amount of break in compound arm 233 has been achieved by shifting arm member 233*c*, wing nut 213 is tightened and the compound arm configuration fixed.

In order to assist the user in selecting the minimum supply air flow which will occur in the "closed" position of the damper, at least one, and preferably a plurality of scales 310 may be provided. As shown, slider member 233*c* is provided with a plurality of slots 311 which are superimposed over a plurality of sloping lines printed on base arm member 233*a*. As adjustment member 233*c* is moved to the right, the line portions on base arm 233*a* appear to move up the slots 311 indicating a greater minimum flow opening for a bigger break in compound arm 233. As the adjustment member is moved to the left, the line portions move down slots 311, indicating a lesser minimum flow opening.

Since the same diffuser control assembly 228 can be used with housings 242 having differing neck sizes to accommodate supply air conduits of differing size, the numeric scale 310 can be provided to correspond to the different standard supply air conduit sizes. The same slider position, therefore will produce lower volumetric minimum flow from smaller supply air conduits (size 6 conduit) than for larger conduits (a size 12 conduit). By reading the conduit size for the appropriate slot 311, the user can adjust the minimum flow for the particular conduit size.

System Balancing

Figure 10:
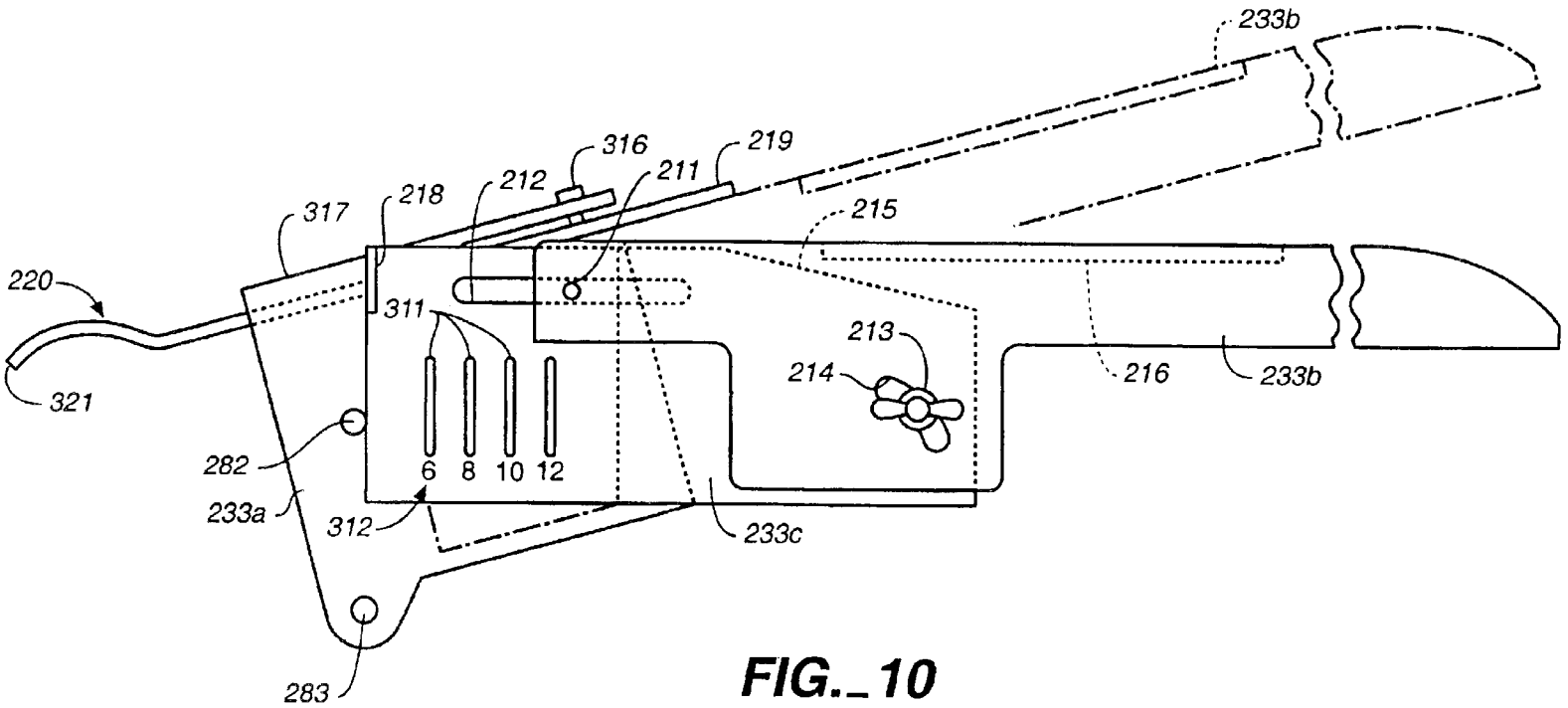
FIG. 10 is an enlarged side elevation view of the compound lever arm assembly employed in the diffuser of FIG. 9 shown in a dropped position for system balancing.
Figure 11:
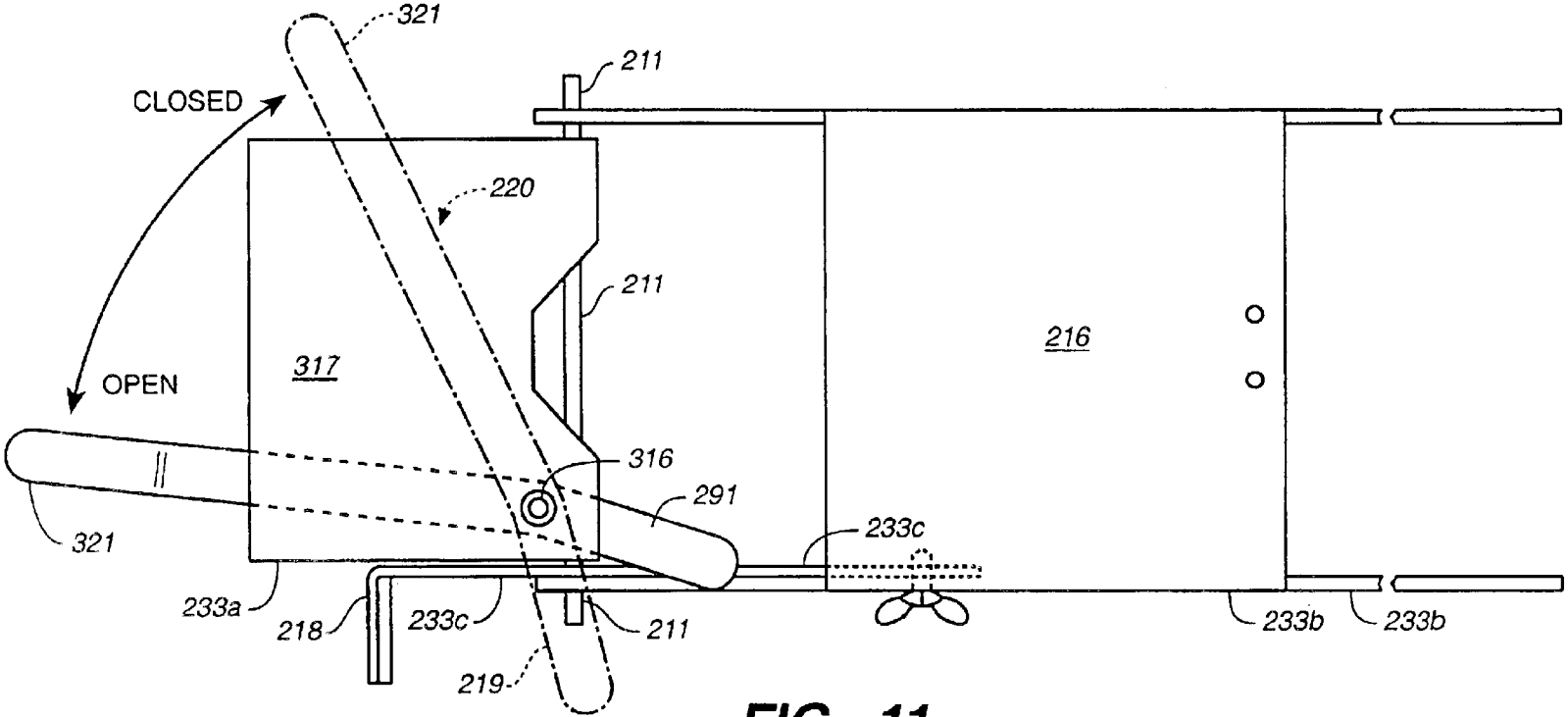
FIG. 11 is a top plan view of the compound lever arm assembly of FIG. 10.

FIGS. 10 and 11 illustrate compound arm 233 in more detail and they also show a preferred additional feature which can be present in the control linkage assembly 228 of the present invention.

When setting up an HVAC system having a plurality of diffusers located at a plurality of different lengths of the supply air conduit from the supply air source, one of the first steps is to balance the system so that the volume of supply air discharged at each diffuser in the fully open position is as designed by the HVAC systems engineer, notwithstanding difference in the lengths of the supply conduit and the number of diffusers on a conduit. This balancing is usually done by dampers (not shown) in the supply air conduits upstream of the neck on which the diffusers are attached. Diffusers are first mounted on the conduits at each opening and all the diffuser dampers 24, 224 are fully opened. The conduit dampers are then adjusted to reflect the varying lengths of conduit and numbers of diffusers and desired volumetric output so as to substantially "balance" the air flowing out of the various diffusers in the open position. This balancing is well known in the art.

The problem with balancing can be that the thermally powered diffusers are always "on," that is, they are always sensing temperatures. Thus, it is desirable to be able to drop damper member 24 or 224 to a fully open position, regardless of the supply air or room air temperature. This is accomplished in the embodiment of FIGS. 9–12 by providing a pivotally mounted balancing arm, generally designated 220. Balancing arm 220 can be seen in FIGS. 10 and 11 to be pivoted at 316 to a transversely extending portion 317 of base arm member 233*a*. In the phantom line position of balancing arm 220 shown in FIG. 11, arm end 219 extends over the top of minimum flow stop adjustment member 233*c*, thus preventing its rotation relative to pin 211, as above described. This is the "closed" position of balancing arm 220.

When balancing arm 220 is rotated in a counterclockwise direction about pivot 316 to the solid line position of FIGS. 10 and 11, end 219 now moves to a position to the right of pin 211, which allows slider 233*c* and damper engaging arm member 233*b* to drop to the solid line position of FIG. 10, regardless of the position to which the sensor-actuators may have driven base arm member 233*a*. As noted above, change-over linkage 275 is coupled to pin 211 and, therefore, also does not interfere with this dropping action. As arm end 219 moves from being over the edge of slider 233*c* on the left side of pin 211, to the right side of pin 211, the slider and damper engaging arm 233 are free to pivot downwardly away from arm 219 in a clockwise direction (FIG. 10). This instantaneously drops damper 224 to a fully open position so that a supply air conduit damper upstream of the diffuser can be used to balance the system.

In the preferred form, balancing lever 220 has an opposite end 321 which extends in the "open" position to a location which can be seen without removal of appearance panel 234. Thus, the dotted line position of end 321 in FIG. 9 can be seen by the user without removal of panel 234. This allows the user to determine whether or not the damper has been dropped to the fully open position for system balancing and is not closed for proper operation. It will be noted that arm end 321 needs to be configured so as to pass over air induction channel extension or intake hood member 322.

The foregoing description of specific embodiments of the present invention has been presented for the purpose of illustration. It is not intended to be exhaustive or to limit the invention to precise forms disclosed, and obviously many modifications and variations are possible in light of the above teaching. The embodiments were chosen and described in order to best explain the principles of the invention and its practical application in order to thereby enable others skilled in the art to best utilize the invention and various embodiments with various modifications as are suited to the particular use contemplated. It is intended that the scope of the invention be defined by the claims appended hereto, when read and interpreted according to accepted legal principles such as the doctrine of equivalents and reversal of parts.

What is claimed is:

1. A thermally powered control assembly for a VAV air diffuser comprising:

a movable damper member formed to extend across a supply air opening of the diffuser and movable relative thereto to vary the volume of supply air discharged from the opening; and a damper position control device including a plurality of thermal sensor-actuators, and a movable linkage assembly operatively associated with the damper member and the sensor-actuators to transmit movement of the sensor-actuators to the damper member for displacement of the damper member to vary the volume of supply air discharged from the diffuser, all of the sensor-actuator elements and all of the movable linkage assembly being positioned on, and accessible from, a room side of the damper member while the diffuser is mounted in a supporting ceiling or wall.

2. The thermally powered control assembly as defined in claim 1, and an air flow directing structure including a room air induction channel positioned below the damper member and a supply air flow channel extending from an intake opening above the damper member to an outlet opening positioned for the discharge of supply air into the room air induction channel in a direction inducing the flow of room air along the room air induction channel; and the plurality of thermal sensor-activators are provided by a room air sensor-actuator positioned for the flow of room air thereover and a supply air sensor-actuator positioned below the damper member for the flow of supply air thereover.

3. The thermally powered control assembly as defined in claim 2 wherein, the air induction channel is provided by an inverted U-shaped member having an open downwardly facing side;

the room air sensor-actuator is positioned in the room air induction channel upstream of discharge of supply air into the room air induction channel, and the supply air sensor-actuator is positioned in the supply air flow channel.

4. The thermally powered control assembly as defined in claim 3 wherein, the movable linkage assembly is formed to produce a changeover between a heating mode and a cooling mode when supply air changes between warm air and cool air;

the movable linkage assembly is formed to produce modulation of the volume of supply air discharged from the diffuser in both the heating mode and the cooling mode based upon the room air temperature sensed by a room air sensor-actuator; and the linkage assembly is formed to provide a heating set point temperature and a cooling set point temperature which are independently adjustable.

5. The thermally powered control assembly as defined in claim 2 wherein, the movable linkage assembly includes a lever having a damper driving portion and a sensor-actuator driven portion, the lever being mounted for pivoting about two spaced apart pivot points;

the thermal sensor-actuator assembly including a room air sensor-actuator mounted to engage the driven portion of the lever to pivot the lever about a selected one of the pivot points; and the thermal sensor-actuator assembly including a supply air sensor-actuator mounted to displace the room air sensor-actuator to produce engagement of the driven portion of the lever for pivoting of the lever about one pivot point when cool supply air is sensed by the supply air sensor-actuator and for pivoting of the lever about the other pivot point when warm supply air is sensed by the supply air sensor-actuator.

6. A thermally powered control assembly for a VAV air diffuser comprising:

a movable damper member formed to extend across a supply air opening of the diffuser and movable relative thereto to vary the volume of supply air discharged from the opening; and a damper position control device including a plurality of thermal sensor-actuators, and a movable linkage assembly operatively associated with the damper member and the sensor-actuators to transmit movement of the sensor-actuators to the damper member for displacement of the damper member to vary the volume of supply air discharged from the diffuser, the damper linkage assembly including an adjustable minimum flow stop assembly causing the damper member to move to an adjustable closed position permitting discharge of supply air from the diffuser, the adjustable minimum flow stop assembly including a pivoted compound lever arm having a configuration which is adjustable from a room side of the damper member.

7. The thermally powered control assembly as defined in claim 6 wherein, the compound lever arm is formed for adjustment of the angle of pivoting of the compound lever arm to adjust the position of the damper member in the closed position.

8. The thermally powered control assembly as defined in claim 7 wherein, the compound lever arm includes an arm base member mounted for pivotal movement and driven by the sensor-actuators, a damper engaging arm member pivotally mounted to the arm base member, and a minimum flow adjustment member movably mounted for adjustment of the relative angle between the arm base member and the damper engaging arm member.

9. The thermally powered control assembly as defined in claim 8 wherein, the compound lever arm includes at least one calibrated scale indicating the minimum flow produced by adjustment of the angle of the damper engaging arm member relative to the arm base member.

10. The thermally powered control assembly as defined in claim 9 wherein, the compound lever arm includes a plurality of calibrated scales indicating the minimum flow produced by adjustment of the angle of the damper engaging arm member relative to the arm base member for a plurality of different supply air duct areas.

* * * * *